US010222755B2

(12) United States Patent
Coakley et al.

(10) Patent No.: US 10,222,755 B2
(45) Date of Patent: Mar. 5, 2019

(54) DEVICE WITH AXIAL LOCK AND RETENTION DEVICE AND METHODS THEREFOR

(71) Applicant: Motorola Mobility LLC, Chicago, IL (US)

(72) Inventors: Brett A Coakley, Chicago, IL (US); Steve C Emmert, McHenry, IL (US); Nicholas A Fraser, Chicago, IL (US); Thomas Gitzinger, Libertyville, IL (US)

(73) Assignee: Motorola Mobility LLC, Chicago, IL (US)

( * ) Notice: Subject to any disclaimer, the term of this patent is extended or adjusted under 35 U.S.C. 154(b) by 421 days.

(21) Appl. No.: 14/692,118

(22) Filed: Apr. 21, 2015

(65) Prior Publication Data

US 2016/0313701 A1 Oct. 27, 2016

(51) Int. Cl.

| | |
|---|---|
| ***G04B 3/04*** | (2006.01) |
| ***G04C 3/00*** | (2006.01) |
| ***G04B 37/08*** | (2006.01) |
| ***G04B 37/10*** | (2006.01) |
| ***G04G 17/02*** | (2006.01) |

(52) U.S. Cl.

CPC ..... *G04B 37/106* (2013.01); *G04B 3/041* (2013.01); *G04B 3/046* (2013.01); *G04B 3/048* (2013.01); *G04B 37/084* (2013.01); *G04B 37/10* (2013.01); *G04B 37/103* (2013.01); *G04C 3/001* (2013.01); *G04G 17/02* (2013.01)

(58) Field of Classification Search

CPC ..... G04B 3/041; G04B 3/046; G04B 3/048; G04B 37/10; G04B 37/103; G04B 37/106

USPC ..... 368/69, 286–291, 306, 308, 319

See application file for complete search history.

(56) References Cited

U.S. PATENT DOCUMENTS

| | | | | |
|---|---|---|---|---|
| 3,130,539 | A * | 4/1964 | Davis | G04B 37/10 368/289 |
| 3,805,326 | A | 4/1974 | Bell et al. | |
| 5,598,383 | A * | 1/1997 | Li | G04B 37/081 368/291 |
| 5,822,279 | A | 10/1998 | Cuche et al. | |
| 6,315,443 | B1 * | 11/2001 | Meyrat | G04B 37/05 368/288 |
| 6,358,076 | B1 | 3/2002 | Haag | |
| 6,762,976 | B1 * | 7/2004 | Tamaru | G04B 37/005 368/281 |
| 7,111,977 | B2 * | 9/2006 | Hiranuma | G04B 37/103 368/288 |

(Continued)

*Primary Examiner* — Daniel P Wicklund
(74) *Attorney, Agent, or Firm* — Philip H. Burrus, IV

(57) ABSTRACT

A device includes a case having a case sidewall defining a circular receiver having a receiving opening and a central axis. A device body, which is waterproof in one or more applications, includes a sidewall defining a receiving aperture. A crown stem includes a push button disposed within a duct of a threaded bushing and one or more O-rings disposed about the actuation stem to allow translation of the actuation stem in the duct while preventing liquids from passing through the duct. The crown stem inserts through the aperture in the case so that the threaded bushing can hermetically seal the receiving aperture when the device body is inserted into the circular receiver to prevent the liquids from entering the receiving aperture.

18 Claims, 17 Drawing Sheets

(56) References Cited

U.S. PATENT DOCUMENTS

| | | | | |
|---|---|---|---|---|
| 7,192,182 | B2 * | 3/2007 | Hiranuma | G04B 37/103 368/288 |
| 7,778,115 | B2 | 8/2010 | Ruchonnet | |
| 8,905,631 | B2 * | 12/2014 | Sakurazawa | G04B 3/043 368/308 |
| 8,926,169 | B1 | 1/2015 | Leung | |
| 2005/0013203 | A1 * | 1/2005 | Hiranuma | G04B 37/10 368/206 |
| 2006/0158964 | A1 * | 7/2006 | Hiranuma | G04B 3/043 368/47 |
| 2010/0187074 | A1 * | 7/2010 | Manni | G04C 3/004 200/4 |
| 2011/0221688 | A1 * | 9/2011 | Byun | H04B 1/385 345/173 |
| 2011/0235471 | A1 * | 9/2011 | Luk | G04C 3/005 368/69 |
| 2012/0120779 | A1 * | 5/2012 | Altenhoven | G04B 37/05 368/300 |

* cited by examiner

DEVICE WITH AXIAL LOCK AND RETENTION DEVICE AND METHODS THEREFOR

BACKGROUND

Technical Field

This disclosure relates generally to a device, and more particularly to a device with a locking housing.

Background Art

Mobile electronic communication devices, such as mobile telephones, smart phones, gaming devices, and the like, are used by billions of people. These owners use mobile communication devices for many different purposes including, but not limited to, voice communications and data communications for text messaging, Internet browsing, commerce such as banking, and social networking.

Advances in electronic device design have resulting in many devices becoming smaller and smaller. Portable electronic devices that once were the size of a shoebox now fit easily in a pocket. Some devices are even wearable on a wrist or attached to a book bag.

Unforeseen issues sometimes accompany technological advance. Illustrating by example, many people wear items primarily as fashion accessories. When an electronic device is configured to be wearable on a wrist for instance, it can be desirable for the user to be able to change the look of appearance of such a device so as not to disrupt their desire to employ wrist-worn objects as fashion accessories. While this is desirable, it is frequently a difficult proposition to achieve. Manufacturers of electronic devices typically prefer to dispose sensitive electronics in a fixed housing that cannot be opened by a user. It would be advantageous to have a device allowing a user to switch housing appearances without altering the operation of the device.

Figure 1:
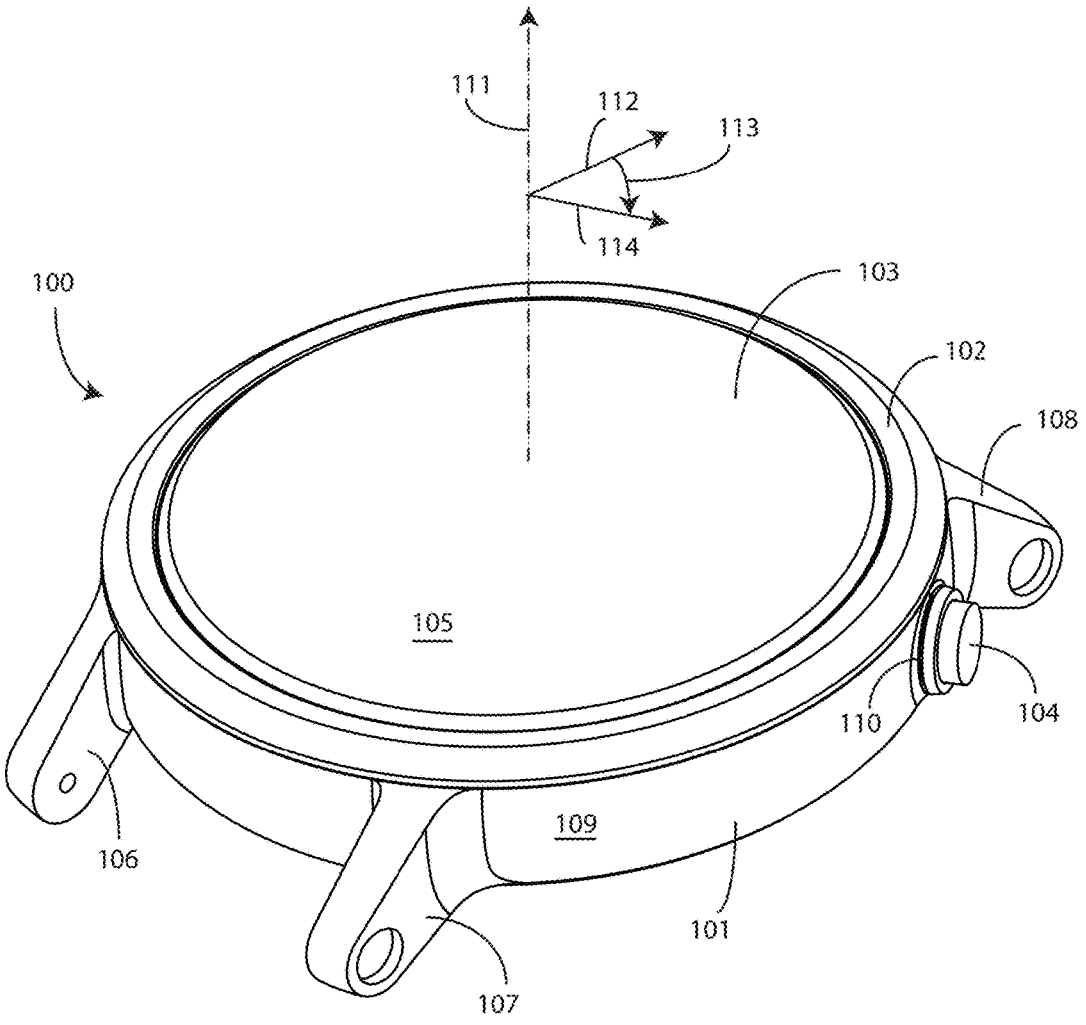
FIG. 1 illustrates a perspective view of one explanatory device in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a device that includes a case, a device body, a bezel, and a crown stem. The device body houses, in one embodiment, electronic circuits, systems, energy sources, and other components of an electronic device. In one or more embodiments, the device body is waterproof to enable a user to use the device while swimming, surfing, boating, bathing, or engaging in other activities involving water. In one embodiment, the device body can be sealed with a lens to form a robust electronic assembly about which the case and bezel can be coupled.

As will be shown in more detail below, in one or more embodiments the bezel, device body, and crown stem are configured with a "twist and lock" system that allows the user to exchange bezels, cases, or combinations thereof at will. Accordingly, a user can conveniently and easily change the housing of the overall device to achieve new appearances. Advantageously, this allows embodiments of the disclosure to satisfy the desire of obtaining different appearances for fashion and other purposes with a single electronic device.

In one embodiment, the bezel attaches to the device body. The device body and bezel combination then insert into a circular receiver of the case. In one embodiment, when the device body and bezel are inserted into the circular receiver, they are rotated to a first rotational alignment relative to the case. They are then inserted into the circular receiver along a central axis such that one or more engagement members engage one or more complementary engagement members.

Once the device body and bezel combination are fully inserted into the case along the central axis, the combination can be rotated to a second rotational alignment about the central axis relative to the case. This rotation results in a receiving aperture in the device body aligning with an aperture in a case sidewall. This rotation also results in the engagement members of the case moving into recesses that preclude the case body and bezel combination from movement along the central axis. The crown stem can then extend through the aperture along an aperture axis into the receiving aperture to function as an axial retention device to retain the device body and bezel in the second rotational alignment about the central axis relative to the case. This "twist and lock" operation will be illustrated in the description accompanying the figures below.

In one or more embodiments, the crown stem comprises a push button that is disposed within a duct of a threaded bushing. One or more O-rings can be disposed about a shaft of the push button to allow translation of the push button in the duct while simultaneously preventing liquids, water, or fluids from passing through the duct. As used herein, "O-rings" refer to the devices known by this name to those of ordinary skill in the art, namely, gasket devices configured in the form of a ring with a circular cross section. O-rings are conventionally manufactured from pliant material such as rubber, polymers, silicone, and so forth. O-rings can be used to form seals between objects.

In one or more embodiments, the crown stem can then insert through the aperture of the case such that the threaded bushing can hermetically seal the receiving aperture of the device body to form a completely waterproof device. The hermetic seal formed between the crown stem and the device body prevents liquids from entering the receiving aperture. In one or more embodiments, a collar can be placed about the crown stem to prevent the threaded bushing from rotating relative to the case and/or the device body. The inclusion of the collar ensures that the hermetic seal between the crown stem and the device body remains sound, thus ensuring the waterproof nature of the overall device.

Embodiments of the disclosure allow a robust electronic device to be created using a case and bezel that are twist-locked about the device body. The robustness of this assembly is derived by the increased mechanical strength of the engagement members held in an interlocked position with the complementary engagement members by the crown stem. Embodiments of the disclosure advantageously allow devices to be created in various form factors, including those having a round shape. For example, embodiments of the disclosure can be configured to have wristwatch appearance, a hockey puck appearance, or other unique shape.

Embodiments of the disclosure allow users to change the "cosmetic skin" of their electronic device at will. At the same time, the bezel and case combination provide a clean and simple design appearance with no visible screws, wrench notches, snaps, or couplers. Moreover, the fact that no external screw bosses are required allows the display of the device to be larger than in prior art designs without increasing the overall form factor of the device. Additionally, the twist and lock feature can be used with many different materials. For example, the bezel and/or case to be manufactured from plastic, metal, ceramic, or other rigid or semi-rigid materials.

Embodiments of the disclosure also allow for electronic devices to be safely and securely housed in a device body that is waterproof. Accordingly, sophisticated electronic devices such as mobile communication devices, smart watches, and so forth can be used in athletic and aquatic applications.

In one or more embodiments, the device can be constructed as almost a completely sealed unit. For example, the device body can be configured to be a waterproof pod that inserts into the case of the device. The electrical components of the device can be secured within the device body. The crown stem engages the receiving aperture of the device body with a hermetic seal inone or more embodiments, thus preventing liquids, moisture, water, fluids, and debris from entering the device body. The case and bezel can then serve as a simple housing twist-locked about the outside of the device body, which can reduce the overall cost of the housing. In prior art electronic devices, housings for electronic devices require multiple screws and/or multiple pins. Assembly therefore takes a lot of time and allows many opportunities for error. With embodiments of the disclosure, the external components are three simple elements: the case, the bezel, and the crown stem. Thus, assembly is simple and robust.

In prior art designs, users must purchase after market covers for their electronic devices if they desire to give them different external appearances. By contrast, embodiments of the present disclosure provide the device body and let a purchaser—on a customized basis even—pick the outer housing, i.e., case and bezel, that they desire. The case and bezel can even be printed, coated, or decorated in a customizable manner Embodiments of the disclosure can completely eliminate the cost and the screws associated with prior art designs. This is in addition to offering the user customization options that were not available previously.

Embodiments of the disclosure can further allow for a "made to order" model for purchasing electronic devices. A purchaser simply goes to a kiosk, store, or on-line portal and picks the colors, coatings, materials, and/or patterns they want for their particular housing and a customized device is shipped to them. Retailers or marketers can order customized devices as well. Other advantages of embodiments of the disclosure will be obvious to those of ordinary skill in the art having the benefit of this disclosure.

Turning now to FIG. 1, illustrated therein is one explanatory device 100 in accordance with one or more embodiments of the disclosure. The device 100 includes a case 101, a bezel 102, a device body 103, and a crown stem 104. The device 100 of FIG. 1 is shown in a fully assembled configuration. The steps for assembling the device 100 will be illustrated in subsequent figures.

The case 101 and bezel 102 can be manufactured from a variety of materials. The case 101 and bezel 102 can be manufactured from the same material in one embodiment. In another embodiment, the case 101 and bezel 102 can be manufactured from different materials. For example, in one embodiment both the case 101 and bezel 102 are manufactured from metal, such as aluminum or steel. In another embodiment, the bezel 102 may be manufactured from a thermoplastic, such as polycarbonate, while the case 101 is manufactured from metal. In another embodiment, the bezel 102 may be manufactured from ceramic, while the case 101 is manufactured from metal. In yet another embodiment, the bezel 102 can be manufactured from ceramic, while the case 101 is manufactured from a thermoplastic. Other materials and combinations will be obvious to those of ordinary skill in the art having the benefit of this disclosure.

The device 100 of FIG. 1 defines a wristwatch appearance in that the case 101 includes one or more lugs to which a strap can be attached. The device 100 can then be worn as a wristwatch as will be shown below with reference to FIG. 18. As noted above, the device 100 can be configured to have other appearances as well.

In one embodiment, the case comprises a case sidewall 109 that defines at least one aperture 110 into which the crown stem 104 can be inserted when the device body 103 is inserted into the case and rotated from a first rotational alignment to a second rotational alignment. In this illustrative embodiment, the device body 103 has an upper major face that is defined by a lens 105. A display is disposed beneath the lens 105 to complete the wristwatch appearance.

In one embodiment, the bezel 102 is attached to the device body 103 such that it circumscribes the lens 105. For example, in one embodiment the bezel 102 can adhesively attach to the device body 103 about the lens 105. In another embodiment, the bezel 102 can frictionally attach to the device body 103 about the lens 105. Other methods of attaching the bezel 102 to the device body 103 will be obvious to those of ordinary skill in the art.

Once the bezel 102 is attached to the device body 103, the combination is inserted into the case 101 along a central axis 111 at a first rotational alignment 112 about the central axis 111 relative to the case 101. The combination is then rotated 113 to a second rotational alignment 114 about the central axis 111 relative to the case 101. When this occurs, the crown stem 104 can insert through the aperture 110 in the case sidewall 109 of the case 101 into a receiving aperture of the device body 103 to retain the combination of device body 103 and bezel 102 coupled to the case 101.

Figure 2:
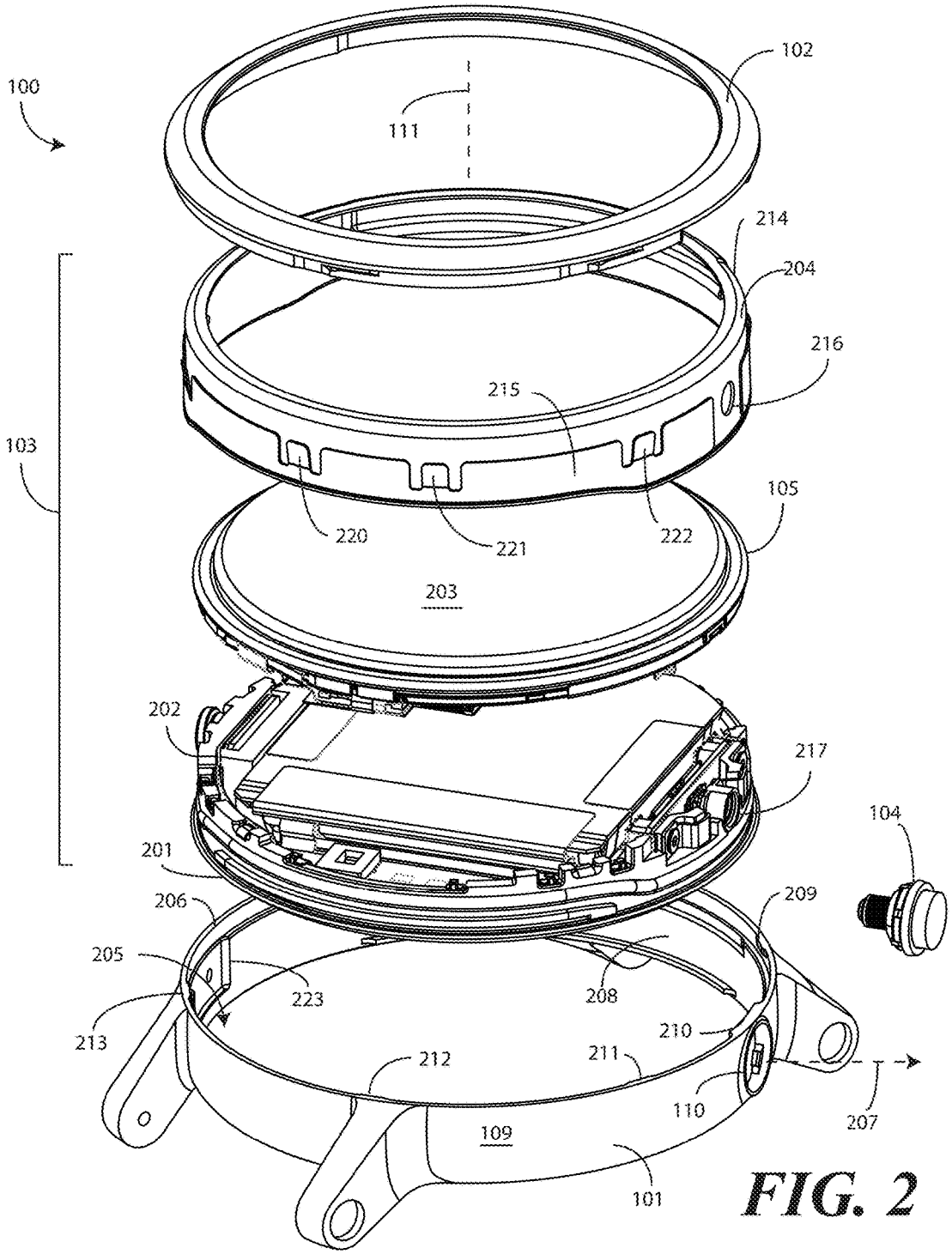
FIG. 2 illustrates an exploded view of one explanatory device in accordance with one or more embodiments of the disclosure.

Turning now to FIG. 2, illustrated therein is an exploded view of the device 100, which illustrates additional details of the various components. The device stack, from bottom to top, includes the following components: the case 101, the device body bottom housing 201, the electronic circuitry 202 of the device, 100, including the upper display 203, which is attached to the bottom side of the lens 105, the device body upper housing 204, and the bezel 102. In this illustrative embodiment, the device 100 is a "smart watch" that includes wireless communication capabilities, biometrics monitoring capabilities, and a display 203 to present information to a user through the lens 105. However, the device 100 could be configured as any number of mechanical or electronic devices. Accordingly, the electronic circuitry 202 is optional. Additionally, where there is no electronic circuitry 202 or display 203, the lens 105 may be replaced with an opaque layer that can optionally be integrally formed with the device body upper housing 204 to reduce the device body 103 external components to two from the three illustratively shown in FIG. 2.

As can be seen in FIG. 2, in one embodiment the case sidewall 109 defines a circular receiver 205 having a receiving opening 206 about the central axis 111. The case sidewall 109 also defines the aperture 110, which is more clearly viewable in FIG. 2 as well. The aperture 110 is disposed about an aperture axis 207. In this embodiment, the aperture axis 207 is substantially orthogonal with the central axis 111 of the receiving opening 206. The term "substantially" or "about" as used herein refers to an alignment inclusive of tolerances. Thus, where a tolerance is plus or minus one degree, both 89.25 and 90.44 degrees would be "substantially orthogonal." While an orthogonal or substantially orthogonal relationship between the aperture axis 207 and the central axis 111 occurs in this embodiment, it is not a requirement. In other embodiments the aperture can be oriented at an angle that is non-orthogonal with the central axis 111.

In one or more embodiments, the inner wall 208 of the case sidewall 109 defines one or more features. Some of these features will be described in more detail below with reference to FIGS. 6-8. However, a particular feature is worthy of note here. In one or more embodiments, the inner wall 208 of the case sidewall 109 comprises one or more engagement members 209,210,211,212,213.

In this illustrative embodiment, each of the one or more engagement members 209,210,211,212,213 comprises a protrusion that extends from the inner wall 208 of the case sidewall 109 toward the central axis 111. However, in other embodiments the one or more engagement members 209, 210,211,212,213 can take other forms. For example, in a complementary embodiment, the one or more engagement members 209,210,211,212,213 can comprise recesses extending into the inner wall 208 of the case sidewall 109. Of course, combinations of protrusions and recesses can be used as well. Alternatively, the one or more engagement members 209,210,211,212,213 can comprise latching members, snap fit members, or other members. Other types of one or more engagement members 209,210,211,212,213 will be obvious to those of ordinary skill in the art having the benefit of this disclosure.

In one embodiment, the one or more engagement members 209,210,211,212,213 are equally spaced about an inner circumference of the case sidewall 109. However, the one or more engagement members 209,210,211,212,213 can be staggered or spaced in accordance with other functions as well. For example, in some embodiments the exterior of the device body 103 can have features, electrical contacts, or other elements in certain locations. Accordingly, in such embodiments the one or more engagement members 209, 210,211,212,213 can be staggered so as to avoid those features or elements when the bezel 102 and device body 103 are inserted into the receiving opening 206 along the central axis 111. Other arrangements for the one or more engagement members 209,210,211,212,213 will be obvious to those of ordinary skill in the art having the benefit of this disclosure.

In this illustrative embodiment the device body 103 includes three components: the device body bottom housing 201, the lens 105, and the device body upper housing 204. Here, the device body bottom housing 201 defines a first major face of the device body 103. In one embodiment, both the device body bottom housing 201 and the device body upper housing 204 are manufactured from metal and are joined together by a process such as friction fitting, press fitting, welding, crimping, stamping, thermal bonding, adhesive bonding, or other techniques. In one or more embodiments, the device body bottom housing 201 and the device body upper housing 204 are joined together by a watertight seal such that the device body 103 is waterproof. For example, in one embodiment the device body bottom housing and the device body upper housing 204 are welded together such that water cannot enter at the seam between the device body bottom housing 201 and the device body upper housing 204. While metal is one material suitable for use as the device body 103, other materials such as thermoplastics can be substituted.

When the device body 103 is configured to waterproof, this means that water cannot enter through any surfaces of the device body 103. For example, water cannot penetrate through walls of either the device body bottom housing 201 or the device body upper housing 204. Nor can water enter the device body 103 through the coupling seam defined between the device body bottom housing 201 and the device body upper housing 204. Of course, if the receiving aperture 216 is open, this would allow water to enter through this aperture. However, as will be described in more detail below, the crown stem 104 can insert through the aperture 110 of the case 101 to hermetically seal the receiving aperture 216 to prevent liquids from entering the receiving aperture 216. Thus, the device body 103 can be waterproof despite the fact that the receiving aperture 216 is open. However, the overall device 100 becomes waterproof when the crown stem 104 hermetically seals the receiving aperture 216.

In this embodiment, the electronic circuitry 202 includes a display 203. Accordingly, the second major face of the device body 103 is defined by the lens 105, which seats within an upper lip 214 of the device body upper housing 204. An O-ring or other seal can be disposed between the perimeter of the lens 105 and the upper lip 214 of the device body upper housing 204 to make the seal therebetween watertight. Where the device 100 included no display, the second major face of the device body 103 could be opaque. For example, a layer of material similar to the device body bottom housing 201 could be attached to, or integrally formed with, the device body upper housing 204.

In this illustrative embodiment, the device body upper housing 204 comprises a sidewall that defines a receiving aperture 216. In one or more embodiments, the electronic circuitry 202 comprises a coupler 217 to which the crown stem 104 couples. Where this is the case, the receiving aperture 216 is to receive a stem 218 of the crown stem 104 when the device body 103 is inserted into the circular receiver 205 along the central axis 111 and then rotated (113) from the first rotational alignment (112) to the second rotational alignment (114). Where no coupler 217 or electronic circuitry 202 is included in the device 100, the receiving aperture 216 can be threaded to serve as such a coupler. As will be described in more detail below with reference to FIGS. 16-17, in one or more embodiments the crown stem 104 can be used as an actuator when coupled to the coupler 217 to actuate the electronic circuitry 202 or otherwise cause it to perform one or more predefined functions.

In one embodiment, the device body 103 comprising one or more electrical contacts 220,221,222 disposed along an exterior of the sidewall 215. In one embodiment, the case 101 includes one or more complementary electrical contacts 223 disposed along an interior 208 of the case sidewall 109. In one embodiment, the one or more complementary electrical contacts 223 are to engage the one or more electrical contacts 220,221,222 when the device body 103 is inserted into the receiving opening 206 and is rotated from the first rotational alignment (112) to the second rotational alignment (114). These electrical contacts 220,221,222 and complementary electrical contacts 223 are optional and may be omitted in some designs.

Figure 3:
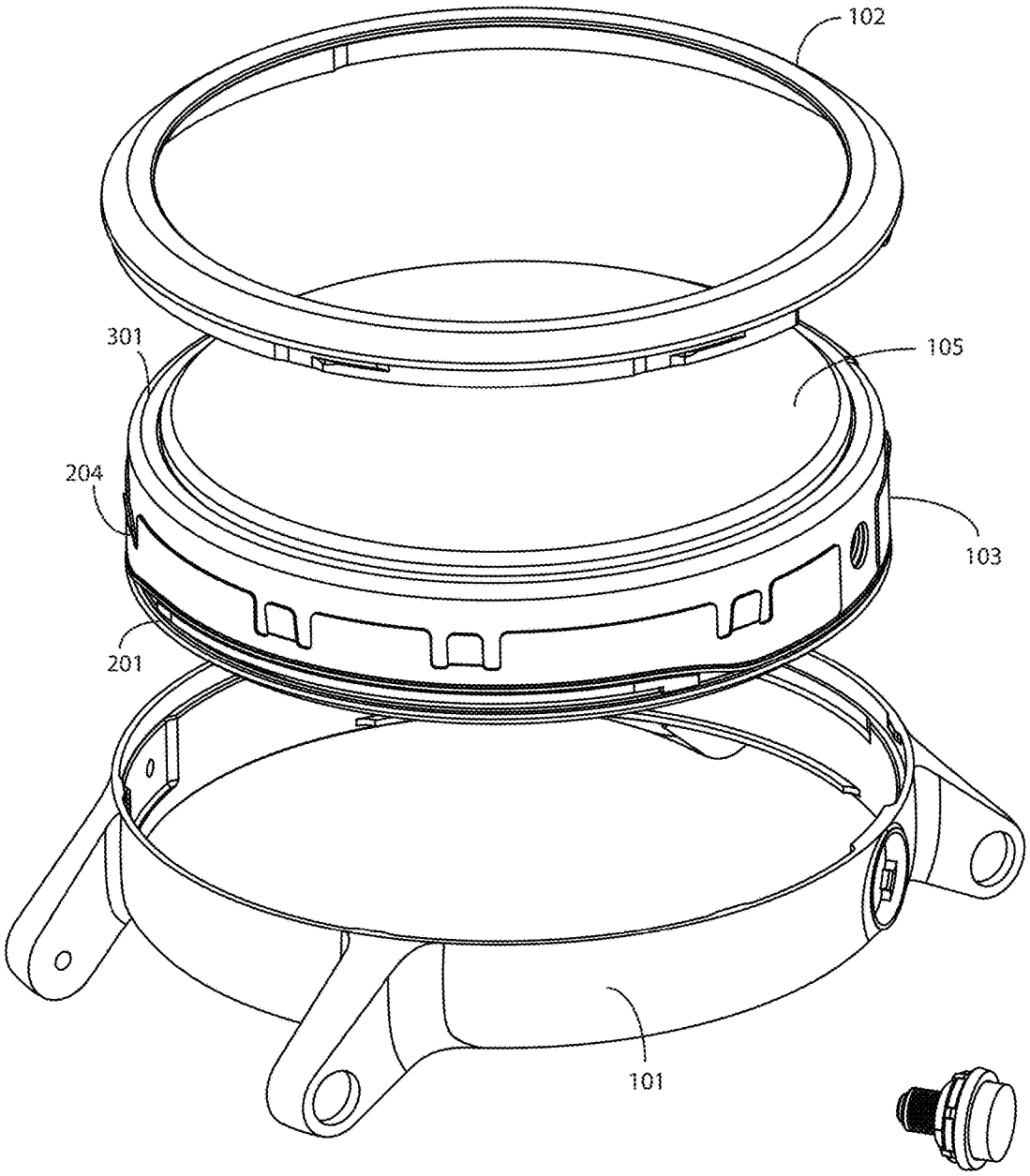
FIG. 3 illustrates another exploded view of one explanatory device in accordance with one or more embodiments of the disclosure.

Turning now to FIG. 3, here the device body bottom housing 201, the lens 105, and the device body upper housing 204 have been joined together about the electronic circuitry (202) to form the device body 103 as an assembled component. In this illustrative embodiment the lens 105 defines a receiving ledge 301 circumscribing the crown 302 of the lens 105. The bezel 102 is to attach to the receiving ledge 301 of the lens 105 to form a bezel-device body assembly, which will be shown in more detail with reference to FIG. 9 below.

As noted above, in one embodiment the device body 103 defines an electronic device about which various "skins" defined by the bezel 102 and the case 101 can be attached. To understand how this occurs, a more detailed understanding of the bezel 102 is beneficial.

Figure 4:
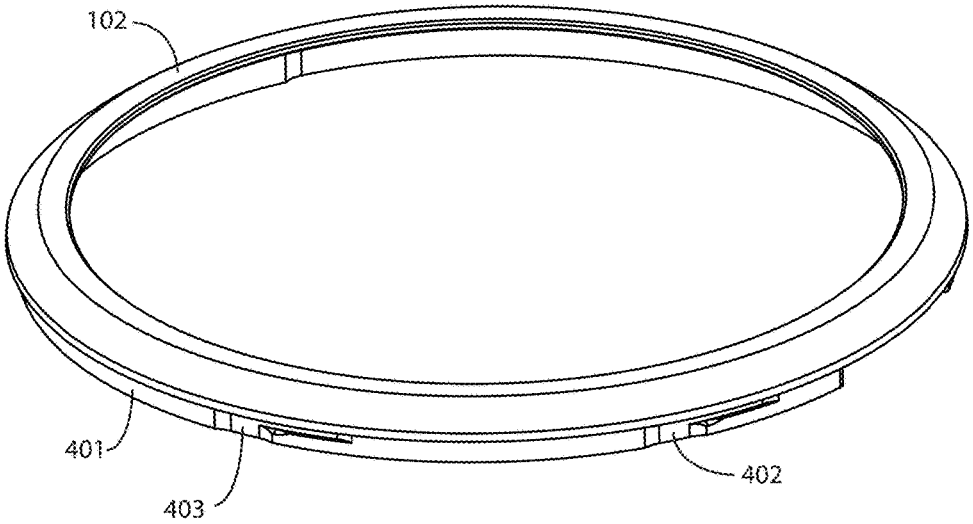
FIG. 4 illustrates a perspective view of one explanatory bezel in accordance with one or more embodiments of the disclosure.
Figure 5:
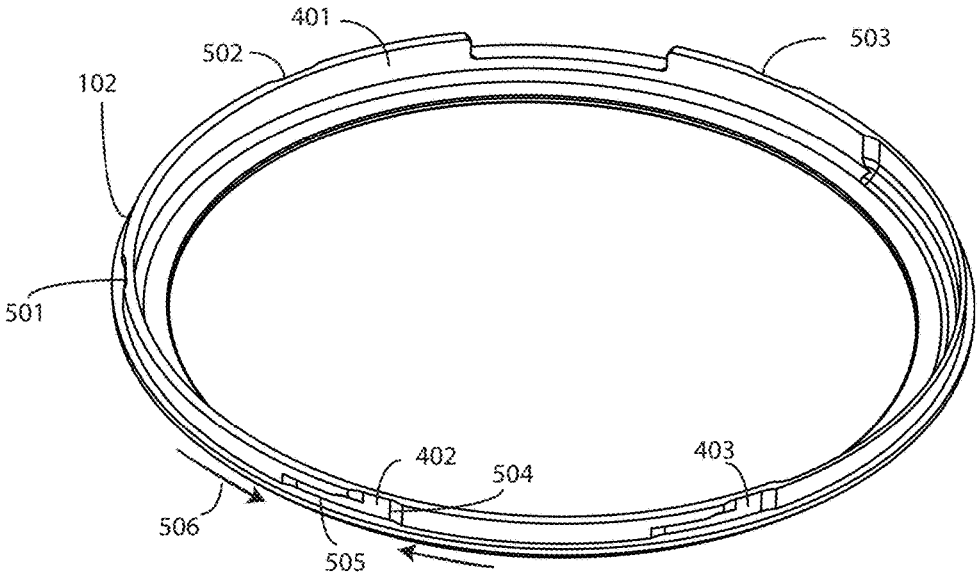
FIG. 5 illustrates another perspective view of one explanatory bezel in accordance with one or more embodiments of the disclosure.

Turning now to FIGS. 4 and 5, illustrated therein is a more detailed view of the bezel 102. FIG. 4 illustrates a top perspective view of the bezel 102, while FIG. 5 illustrates a bottom perspective view of the bezel 102. In one or more embodiments, the bezel 102 comprises an annular engagement ring 401. In one embodiment, the annular engagement ring 401 performs multiple functions. First, the annular engagement ring 401 is to attach to the receiving ledge (301) or other complementary mechanical feature of the lens (105) or other major face of a device body (103). Second, the annular engagement ring 401 is to attach to the case (101) at the receiving opening (206).

In one embodiment, the exterior of the annular engagement ring 401 defines one or more complementary engagement features 402,403,501,502,503. In one embodiment, the complementary engagement features 402,403,501,502,503 are to engage the one or more engagement members (209, 210,211,212,213) when the device body (103) is inserted into the circular receiver (205) of the case (101) along the central axis (111) and rotated (113) from a first rotational alignment (112) to a second rotational alignment (114) about the central axis (111) relative to the case (101).

As the one or more engagement members (209,210,211, 212,213) of FIG. 2 comprised protrusions, in this illustrative embodiment the one or more complementary engagement features 402,403,501,502,503 comprise receiving slots to receive the one or more protrusions when the device body (103) is inserted into the circular receiver (205) of the case (101) along the central axis (111) and rotated (113) from a first rotational alignment (112) to a second rotational alignment (114) about the central axis (111) relative to the case (101). However, had the one or more engagement members (209,210,211,212,213) been recesses, the one or more complementary engagement features 402,403,501,502,503 could have comprises protrusions. As noted above, combinations could be used. Also, other forms of complementary engagement features 402,403,501,502,503 will be obvious to those of ordinary skill in the art having the benefit of this disclosure.

In this illustrative embodiment, each of the one or more complementary engagement features 402,403,501,502,503 comprises an L-shaped recess extending into the exterior of the annular engagement ring 401. For example, complementary engagement feature 402 includes a short side 504 of the L-shape and a long side 505 of the L-shape.

In one embodiment, the one or more receiving slots defining the one or more complementary engagement features 402,403,501,502,503 are to receive the one or more protrusions defining the one or more engagement members (209,210,211,212,213) along the short side 504 of the L-shaped recess when the device body (103) is inserted into the circular receiver (205) of the case (101) along the central axis (111) at the first rotational alignment (112). Once the device body (103) is fully inserted into the case (101) along the central axis (111), in one embodiment the one or more protrusions defining the one or more engagement members (209,210,211,212,213) are to travel along a long side 505 of the L-shaped recess defining the one or more complementary engagement features 402,403,501,502,503 when the device body (103) is rotated (113) from the first rotational alignment (112) to the second rotational alignment (114). In one embodiment, the rotational difference between the first rotational alignment (112) and the second rotational alignment (114) is defined by a length 506 of the long side 505 of the L-shaped recess.

Figure 6:
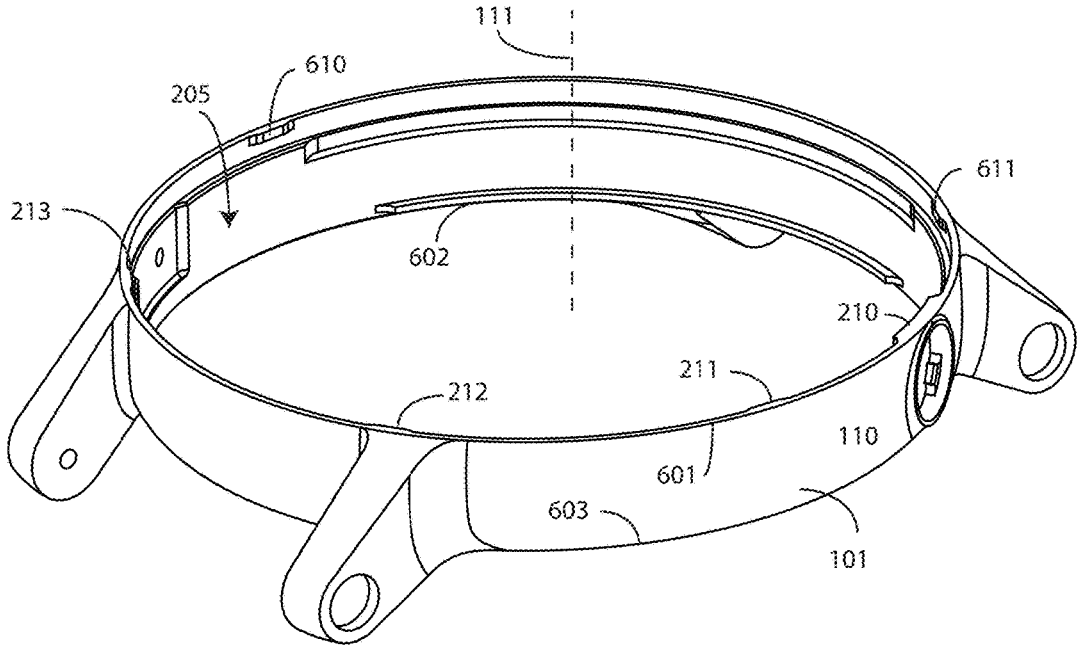
FIG. 6 illustrates a perspective view of one explanatory device case in accordance with one or more embodiments of the disclosure.
Figure 7:
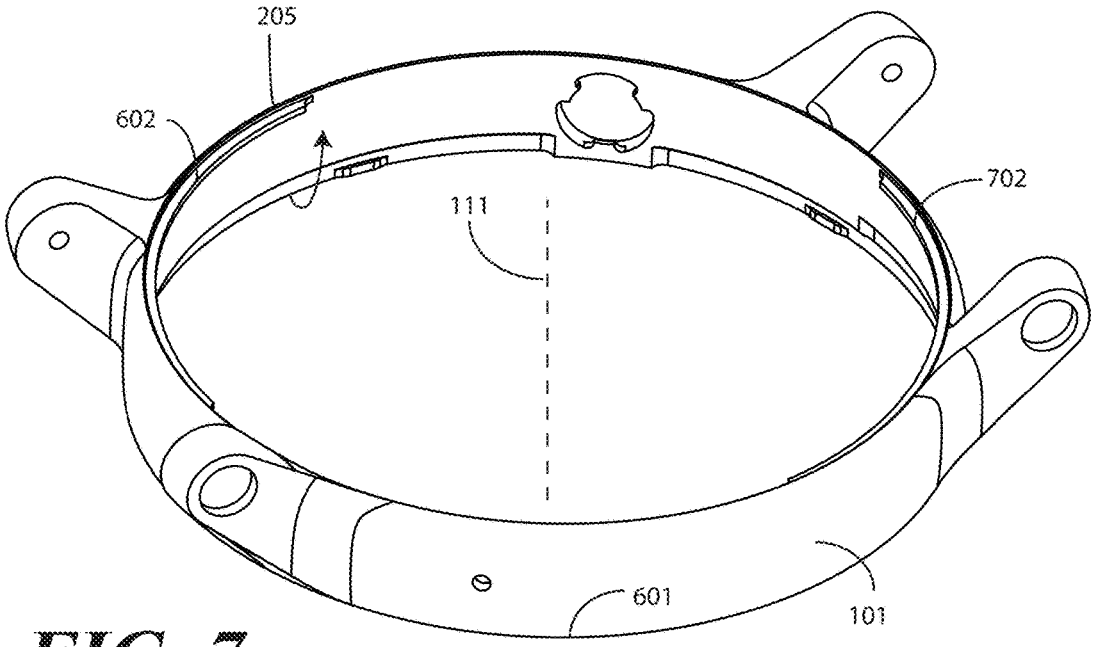
FIG. 7 illustrates another perspective view of one explanatory device case in accordance with one or more embodiments of the disclosure.

Turning now to FIGS. 6-7, illustrated therein is a more detailed view of the case 101. FIG. 6 illustrates a top perspective view of the case 101, while FIG. 7 illustrates a bottom perspective view of the case 101. As noted above, in one or more embodiments the case 101 defines a circular receiver 205 having a central axis 111 and at least one aperture 110 oriented substantially orthogonally with the central axis 111. Additionally, in one or more embodiments the case 101 includes one or more engagement members 210,211,212,213,610,611 disposed about a top edge 601 of the circular receiver 205. Here, the one or more engagement members 210,211,212,213,610,611 are protrusions that extend inwardly from the top edge 601 of the circular receiver 205 toward the central axis 111. As also noted above, the one or more engagement members 210,211,212,213,610,611 could be recesses or other types of engagement members as well.

In this illustrative embodiment, the case 101 also includes one or more attachment devices 602,702 that can be used to engage a base of a device body (103), such as device body bottom housing (201). In this illustrative example, the one or more attachment devices 602,702 are protrusions extending inwardly from the bottom edge 603 of the case 101 toward the central axis 111.

In one or more embodiment the device body (103) can have one or more complementary attachment devices that attach to the one or more attachment devices 602,702 when the device body (103) is inserted into the circular receiver 205 of the case 101 along the central axis 111 and rotated (113) from a first rotational alignment (112) to a second rotational alignment (114) about the central axis 111 relative to the case 101.

In other embodiments, the attachment devices 602,702 can define mechanical stops that prevent the device body (103) from passing through the case 101 when inserted through the circular receiver 205 along the central axis 111. In such embodiments, the attachment devices 602,702 serve as shelves or ledges atop which the device body (103) sits upon insertion into the circular receiver 205 along the central axis 111. The device body (103) then rotates atop the attachment devices 602,702 when the device body (103) is inserted into the circular receiver 205 of the case 101 along the central axis 111 and rotated (113) from a first rotational alignment (112) to a second rotational alignment (114) about the central axis 111 relative to the case 101. This is how the explanatory attachment devices 602,702 of the embodiment of FIGS. 6-7 function. The one or more attachment devices 602,702 of FIGS. 6-7 are therefore significantly wider than are the one or more engagement members 210,211,212,213,610,611.

Figure 8:
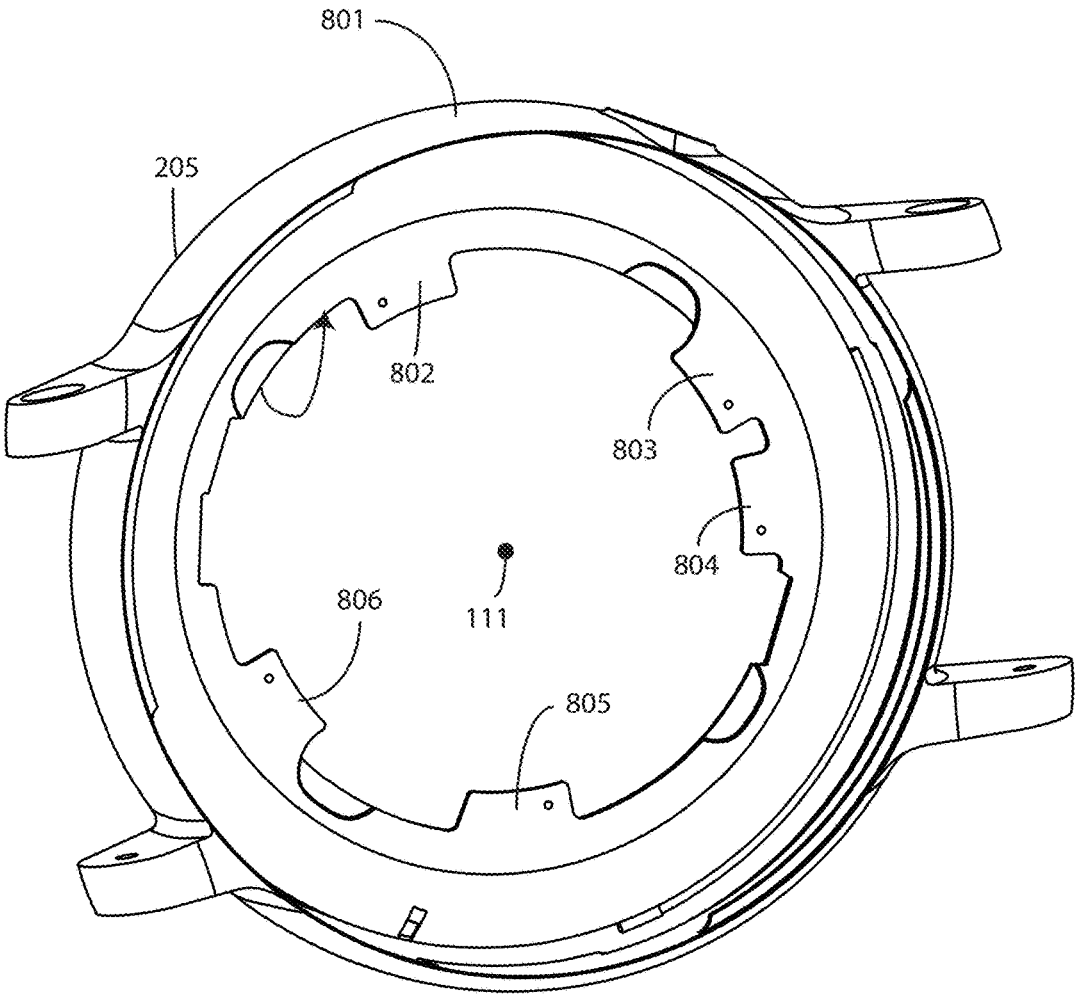
FIG. 8 illustrates a perspective view of an alternate device case in accordance with one or more embodiments of the disclosure.

By contrast, turning now to FIG. 8, here the one or more attachment devices 806,802,803,804,805 are configured as protrusions that engage one or more recesses in a device body (103) when the device body (103) is inserted into the circular receiver 205 of the case 801 along the central axis 111 and rotated (113) from a first rotational alignment (112) to a second rotational alignment (114) about the central axis 111 relative to the case 801.

As with the one or more engagement members (209,210,211,212,213) of FIGS. 2, 6, and 7, while the one or more attachment devices 806,802,803,804,805 comprise protrusions in this illustrative embodiment to engage recesses or receiving slots in a device body (103) when the device body (103) is inserted into the circular receiver 205 of the case 801 along the central axis 111 and rotated (113) from a first rotational alignment (112) to a second rotational alignment (114) about the central axis 111 relative to the case 801, the one or more attachment devices 806,802,803,804,805 could be configured as recesses to engage protrusions on the device body (103). As noted above, combinations of recesses and protrusions could also be used. Other forms of one or more attachment devices 806,802,803,804,805 will be obvious to those of ordinary skill in the art having the benefit of this disclosure.

Figure 19:
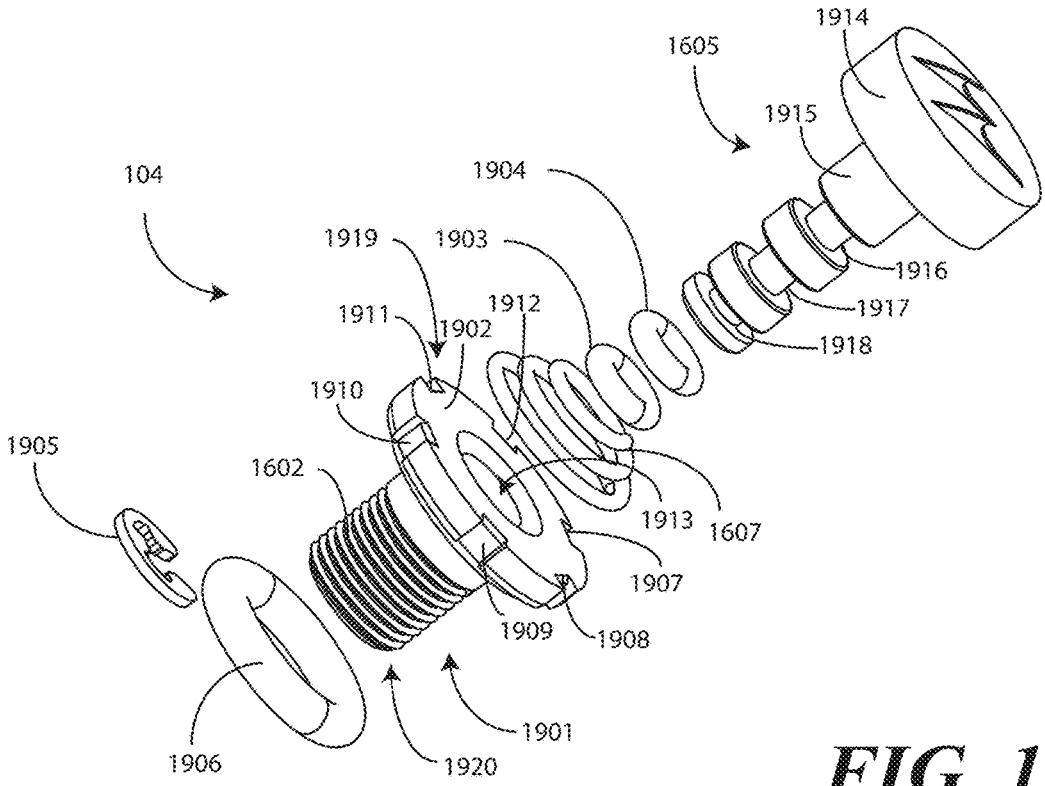
FIG. 19 illustrates one explanatory crown stem in accordance with one or more embodiments of the disclosure.

Turning now to FIG. 19, illustrated therein is an exploded view of one explanatory embodiment of the crown stem 104. In this illustrative embodiment, the crown stem 104 comprises a push button 1605, a threaded bushing 1901, a spring 1607 that is coiled in this embodiment, one or more O-rings 1903,1904, a retention clip 1905, and an additional O-ring 1906.

In this illustrative embodiment, the threaded bushing 1901 comprises a threaded male member 1602 and a base member 1902. The base member 1902 defines a plane in one embodiment that is substantially orthogonal with a central axis of the threaded male member 1602. In this illustrative embodiment, the base member 1902 has a circular plan view with one or more slots 1907,1908,1909,1910,1911,1912 disposed about a perimeter of the base member 1902.

These slots 1907,1908,1909,1910,1911,1912 can be used in a variety of ways. For example, in one embodiment a tool can engage the slots 1907,1908,1909,1910,1911,1912 to rotate the crown stem 104 into the receiving aperture (216) of a device body (103) to hermetically seal the receiving aperture (216). This will be explained below with reference to FIG. 27. In other embodiment, a one or more cantilevered snap elements can engage the slots 1907,1908,1909,1910,1911,1912 to prevent the crown stem 104 from rotating relative to a case (101) or device body (103). This will be explained in more detail below with reference to FIGS. 20-21.

In one embodiment, the push button 1605 comprises a crown boss 1914 and a shaft 1915. The shaft 1915 extends distally from the crown boss 1914 along an axis. When the crown stem 104 is assembled, the crown boss 1914, the base member 1902, and optionally the collar of FIGS. 20,21 below, form the crown (1603) of the crown stem 104.

In one embodiment, the threaded bushing 1901 defines a duct 1913, which forms a channel or tube through the threaded bushing 1901 into which the push button 1605 can be inserted, and into which the push button 1605 can translate along an axis of the shaft 1915. As shown in FIG. 19, in one embodiment the duct 1913 begins at an aperture of the base member 1902 and extends through the threaded male member 1602 so that the shaft 1915 of the push button 1605 can extend all the way through the threaded bushing 1901. This will be shown in more detail with reference to FIGS. 22-26.

In this illustrative embodiment, the shaft 1915 defines one or more recesses 1916,1917,1918. In one embodiment, a width of some of the recesses 1916,1917 is complementary in width to the diameter of the cross section of each O-ring 1903,1904 taken along an axis of the shaft 1915. Accordingly, in one embodiment these O-rings 1903,1904 can be disposed about the shaft 1915 and in the recesses 1916,1917 on a one-to-one basis. The two O-rings 1903,1904 of this explanatory embodiment can thus be disposed about the push button 1605 and in the two recesses 1916,1917 to allow translation of the push button 1605 in the duct 1913 while preventing liquids from passing through the duct 1913. Advantageously, by abutting both the shaft 1915 of the push button 1605 and the inner walls of the duct 1913, the O-rings 1903,1904 provide a reliable, waterproof seal that still allows translation of the push button 1605 into, and out of, the duct 1913.

In one embodiment, the retention clip 1905 is to attach to the shaft 1915 when the push button 1605 is passed through the duct 1913 from a first side 1919 of the threaded bushing 1901 far enough that recess 1918 extends through a second side 1920 of the threaded bushing 1901. In this illustrative embodiment, the spring 1607 is disposed between the threaded bushing 1901 and the push button 1605 to apply a pre-loading force biasing the push button 1605 away from the base member 1902 of the threaded bushing 1901. The retention clip 1905 couples to the recess 1918 of the shaft 1915 of the push button 1605 at the second side 1920 of the threaded bushing 1901 to retain the shaft 1915 of the push button 1605 within the duct 1913 when the spring 1607 biases the crown boss 1914 of the push button 1605 away from the base member 1902 of the threaded bushing 1901. In this illustrative embodiment, the spring 1607 is disposed about the shaft 1915 of the push button 1605 and is at the first end 1919 of the threaded bushing 1901 while the retention clip 1905 is disposed at the second side 1920 of the threaded bushing 1901.

In this illustrative embodiment, an additional O-ring 1906 is disposed about the threaded bushing 1901. In one embodiment, the additional O-ring 1906 is disposed between the threads of the threaded male member 1602 and the underside of the base member 1902 so as to be adjacent to the second side 1920 of the base member 1902. Thus, when the threaded bushing 1901 is threaded into the receiving aperture (216) or a device body (103), the additional O-ring 1906 can be captured between the case (101) and the base member 1902 of the threaded bushing 1901 to further render the resulting device waterproof.

Figure 20:
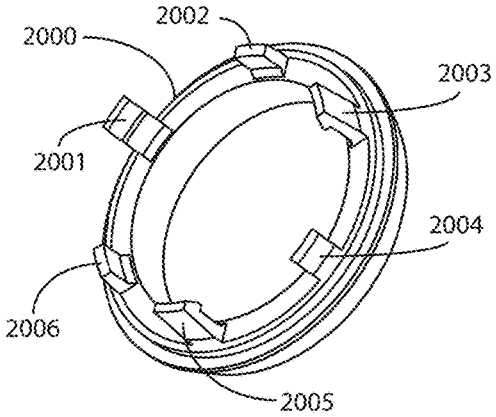
FIGS. 20-21 illustrate one explanatory collar in accordance with one or more embodiments of the disclosure.
Figure 21:
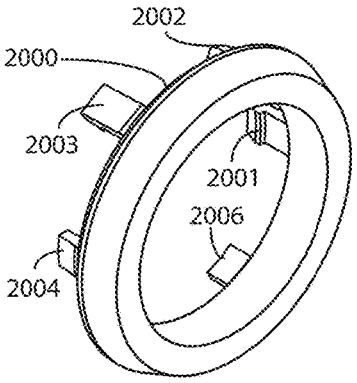
Figure 22:
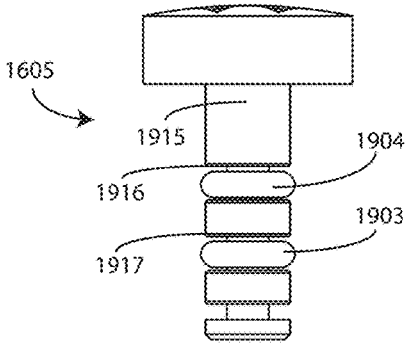
FIGS. 22-26 illustrate an explanatory method of assembling a crown stem in accordance with one or more embodiments of the disclosure.

Turning now to FIGS. 20-21, illustrated therein is an optional collar 2000 that can be used in conjunction with the crown stem (104) of FIG. 19. In one or more embodiments, when the threaded bushing (1901) is threaded into the receiving aperture (216) or a device body (103), a hermetic seal is formed between the threaded male member (1602) and the receiving aperture (216). In one or more embodiments the collar 2000 can be locked about the crown boss (1914) of the crown stem (104) to prevent rotation of the crown stem (104) relative to the device body (103) or the case (101). Advantageously, inclusion of the collar 2000 ensures that the hermetic seal providing the waterproof capabilities of the overall device is not compromised.

Recall from above that in one or more embodiments the base member (1902) has a circular plan view with one or more slots (1907,1908,1909,1910,1911,1912) disposed about a perimeter of the base member 1902. In one embodiment, the collar comprises one or more cantilevered snap elements 2001,2002,2003,2004,2005,2006 that can engage the one or more slots (1907,1908,1909,1910,1911,1912) after the threaded bushing (1901) is hermetically coupled to the receiving aperture (216) of the device body (103) to prevent rotation of the crown stem (104) relative to either the device body (103) or the case (101). In one or more embodiments, the collar 2000 simply snaps about the crown boss (1914) once the threaded bushing (1901) is hermetically coupled to the receiving aperture (216) of the device body (103).

Turning now to FIGS. 22-26, illustrated therein is one explanatory method of assembling a crown stem 104 in accordance with one or more embodiments of the disclosure. Beginning with FIG. 22, in one embodiment two O-rings 1903,1904 can be disposed about the shaft 1915 of a push button 1605. In this explanatory embodiment, the two O-rings 1903,1904 are disposed in recesses 1916,1917 on a one-to-one basis. The two O-rings 1903,1904 allow translation of the push button 1605 in the duct (1913) of the threaded bushing (1901) while preventing liquids from passing through the duct (1913).

Figure 23:
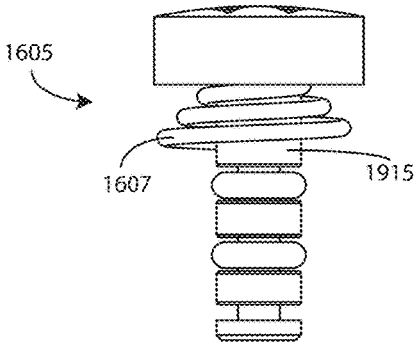
Figure 24:
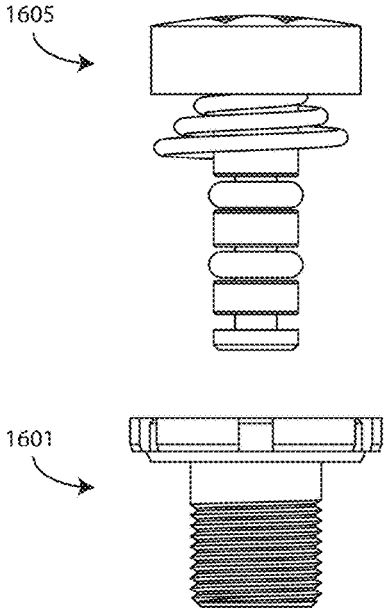
Figure 25:
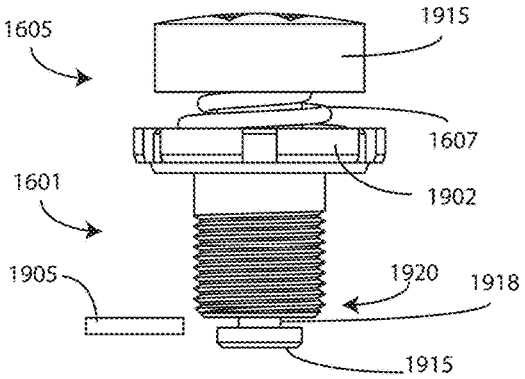
Figure 26:
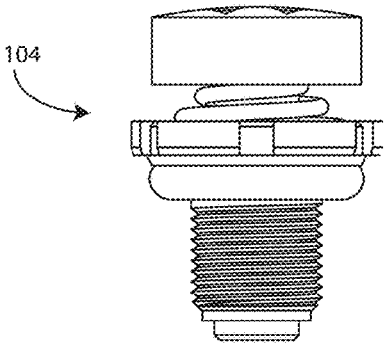

Turning now to FIG. 23, the shaft 1915 of the push button 1605 is passed through the center of the spring 1607, which is a coiled spring in this embodiment. The spring 1607 is then moved along the shaft 1915 until it abuts the bottom surface of the crown stem 104. Turning to FIG. 24, the push button 1605 then passes through the duct (1913) of the threaded bushing 1901 as previously described. As shown in FIG. 25, once the push button 1605 is disposed within the duct (1913) of the threaded bushing 1901, the crown boss 1914 can be pushed toward the base member 1902 of the threaded bushing to compress the spring 1607. This causes the base of the shaft 1915 to extend beyond the second side 1920 of the threaded male member 1601, thereby exposing recess 1918, to which the retention clip 1905 can be attached. The assembled crown stem 104 is shown in FIG. 26.

Figure 27:
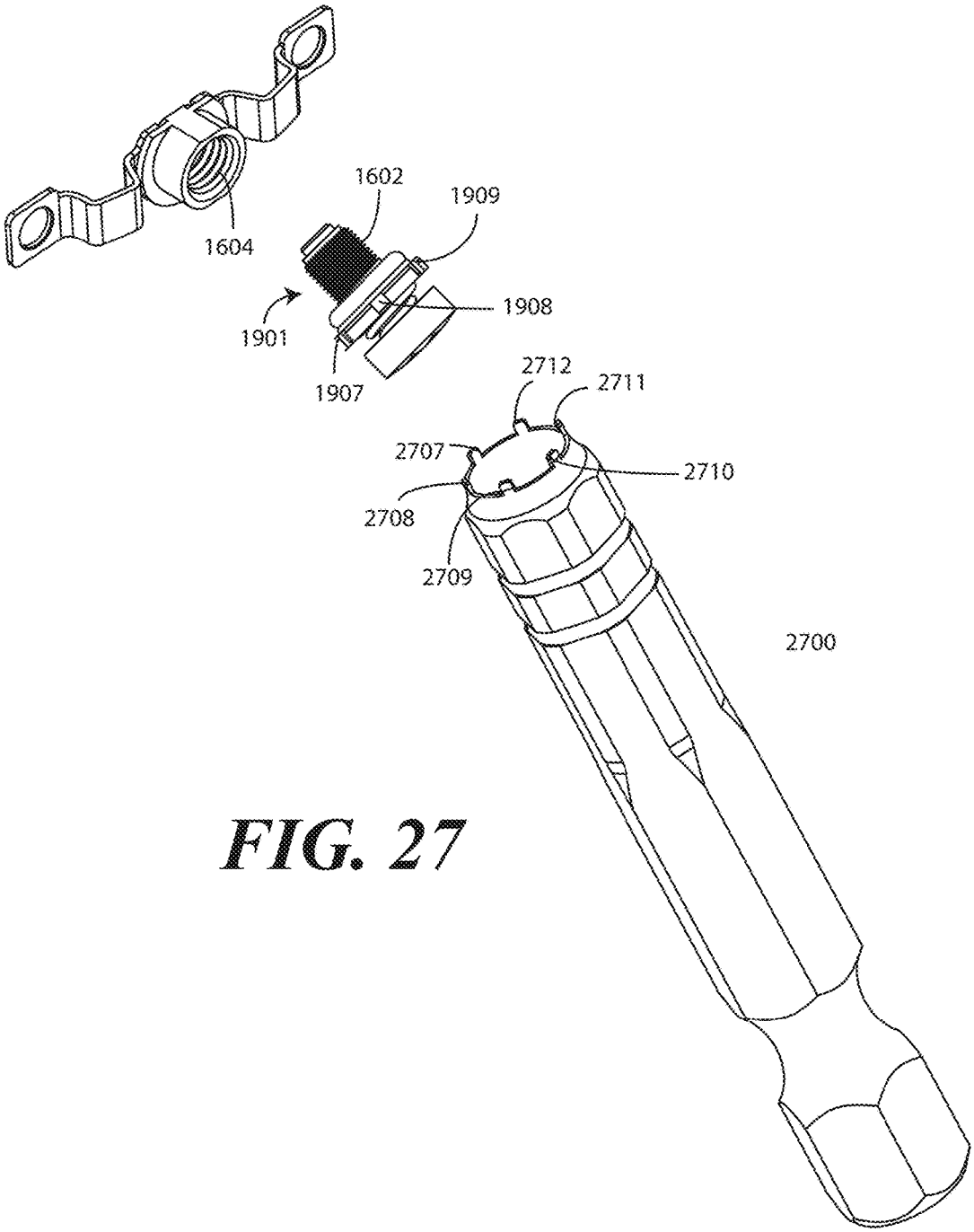
FIG. 27 illustrates an explanatory method of forming a hermetic seal in accordance with one or more embodiments of the disclosure.

Turning now to FIG. 27, illustrated therein is a method of assembling at least a portion of a device (100) in accordance with one or more embodiments of the disclosure. As noted above, the slots 1907,1908,1909 of the threaded bushing 1901 can be used for multiple purposes. In this illustration, a special tool 2700 includes one or more teeth 2707,2708, 2709,2710,2711,2712 to engage the slots 1907,1908,1909 so that the threaded male member 1602 can be inserted into a female threaded member 1604 of the receiving aperture (216) of the device body (103).

Figure 28:
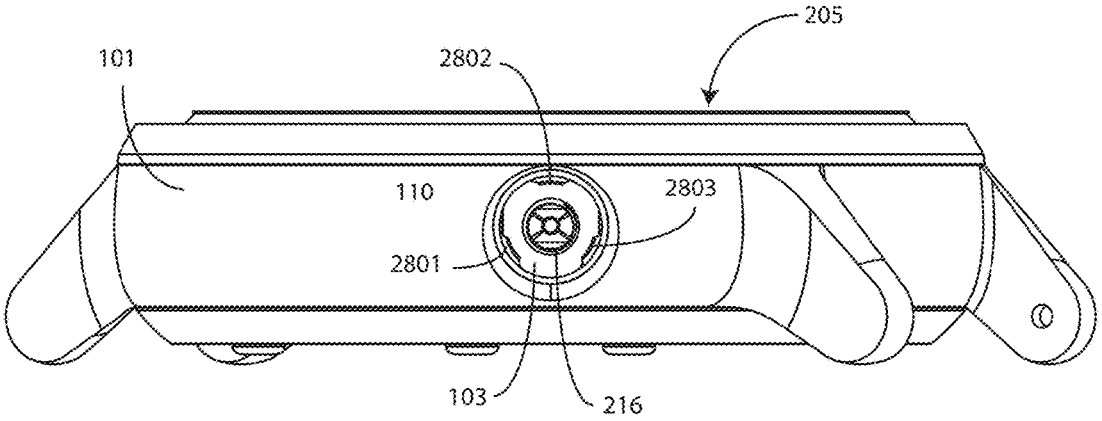
FIG. 28 illustrates one explanatory case in accordance with one or more embodiments of the disclosure.

As shown in FIG. 28, in one or more embodiments the case 101 can include one or more mechanical stops 2801, 2802,2803 to limit the insertion of the crown stem (104) into the at least one aperture 110 when the threaded male member (1601) inserts into the threaded female member (2701) of the receiving aperture 216 of the device body 103 to hermetically seal the receiving aperture 216 when the device body 103 is inserted into the circular receiver 205 to prevent the liquids from entering the receiving aperture 216. Where the collar (2000) is used to prevent rotation of the crown stem (104) relative to the case 101 or device body 103, the one or more cantilevered snap elements (2001,2002,2003, 2004,2005,2006) can extend beyond the one or more mechanical stops 2801,2802,2803 when the crown stem (104) hermetically seals the receiving aperture 216 and the one or more cantilevered snap elements (2001,2002,2003, 2004,2005,2006) engage the one or more slots (1907,1908, 1909,1910,1911,1912) in one or more embodiments.

Figure 9:
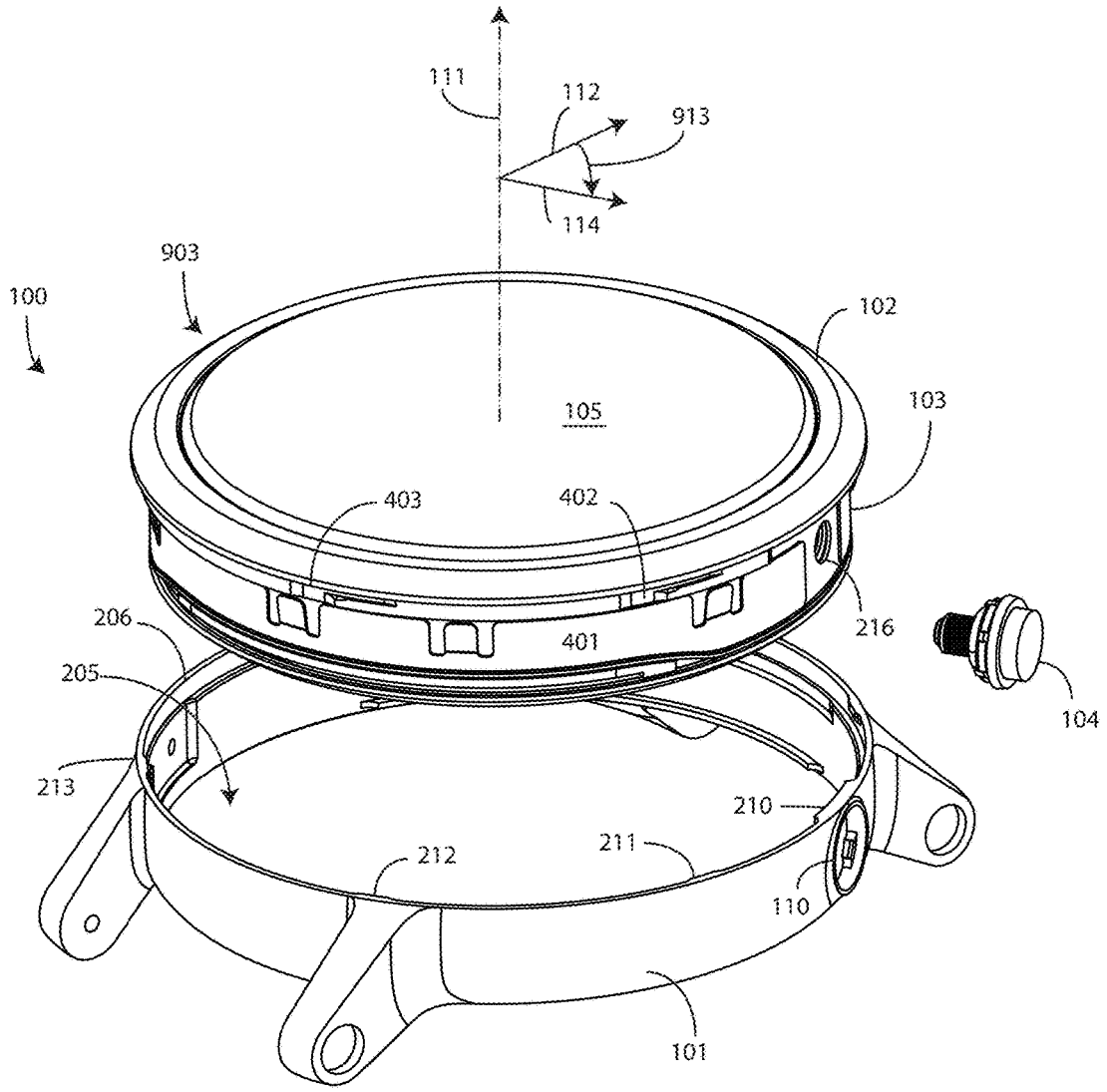
FIG. 9 illustrates another exploded view of one explanatory device in accordance with one or more embodiments of the disclosure.

Turning now to FIG. 9, illustrated therein is the device 100 of FIGS. 1-3 with the bezel 102 attached to the device body 103. In this illustrative embodiment, the bezel 102 is adhesively attached to the lens 105, which defines a major face of the device body 103. The bezel 102 could be coupled to the device body 103 in other ways as well. For example, the bezel 102 could be frictionally coupled to the device body 103. The bezel 102 could be integrally formed with the device body 103 or lens 105 where the bezel 102 is not intended to be interchangeable or performs a function other than providing a decorative appearance. In still other embodiments, the bezel 102 could be coupled to the device body 103 by mechanical features, such as snap-fit features. Other techniques for coupling the bezel 102 to the device body 103 will be obvious to those of ordinary skill in the art having the benefit of this disclosure.

When the bezel 102 is coupled to the device body 103, the combination forms an insert 903 to seat within the circular receiver 205 of the case 101. Where the device body 103 houses an electronic device, such as a smart watch or other wireless communication device, the insert 903 comprises the bezel 102 coupled to the electronic device.

By way of the annular engagement ring 401 of the bezel 102, the insert 903 includes one or more complementary engagement features 402,403 to engage the one or more engagement members 210,211,212,213 of the case 101. As previously described, in one embodiment the insert 903 is rotatable 913 about a central axis 111 between a first rotational alignment 112 about the central axis 111 relative to the case 101 and a second rotational alignment 114 about the central axis 111 relative to the case 101. Additionally, the insert 903 is movable along the central axis 111 when in the first rotational alignment 112 and immobile along the central axis 111 when in the second rotational alignment 114 due to the engagement of the one or more engagement members 210,211,212,213 with the one or more complementary engagement features 402,403 and/or the device body 103 seating against or engaging the one or more attachment devices 602.

Once the device body 103 is rotated from the first rotational alignment 112 to the second rotational alignment 114, the receiving aperture 216 of the device body 103 aligns with the aperture 110 of the case sidewall 109. Additionally, the bezel 102 couples to the case 101 at the receiving opening 206 of the circular receiver 205. The crown stem 104 then inserts through the aperture 110 into the receiving aperture 216 to retain the insert 903 in the second rotational alignment 114 when coupled to the device body 103 through the aperture 110.

Figure 10:
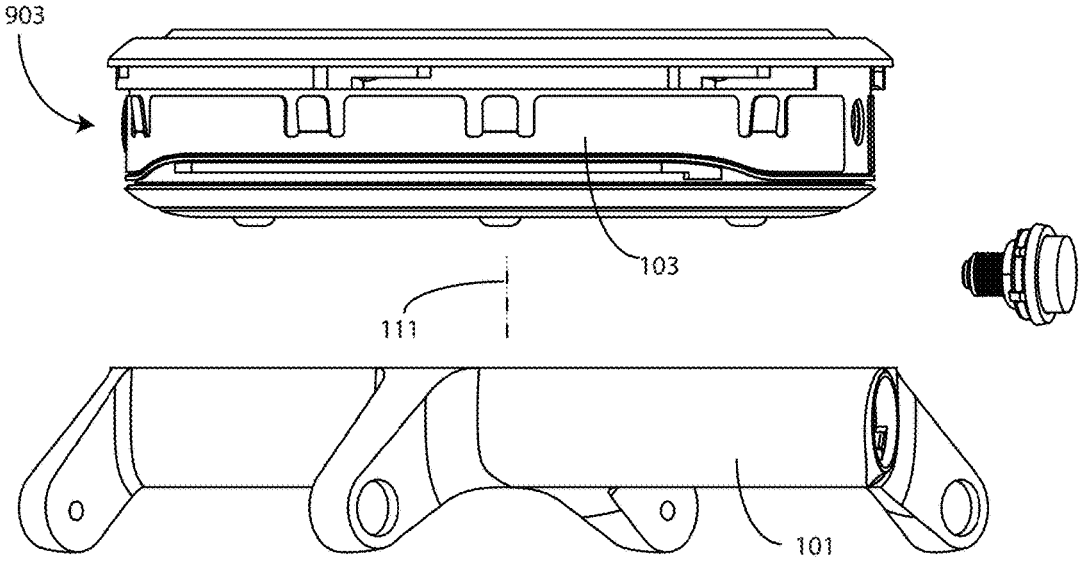
FIG. 10 illustrates yet another exploded view of one explanatory device in accordance with one or more embodiments of the disclosure.
Figure 11:
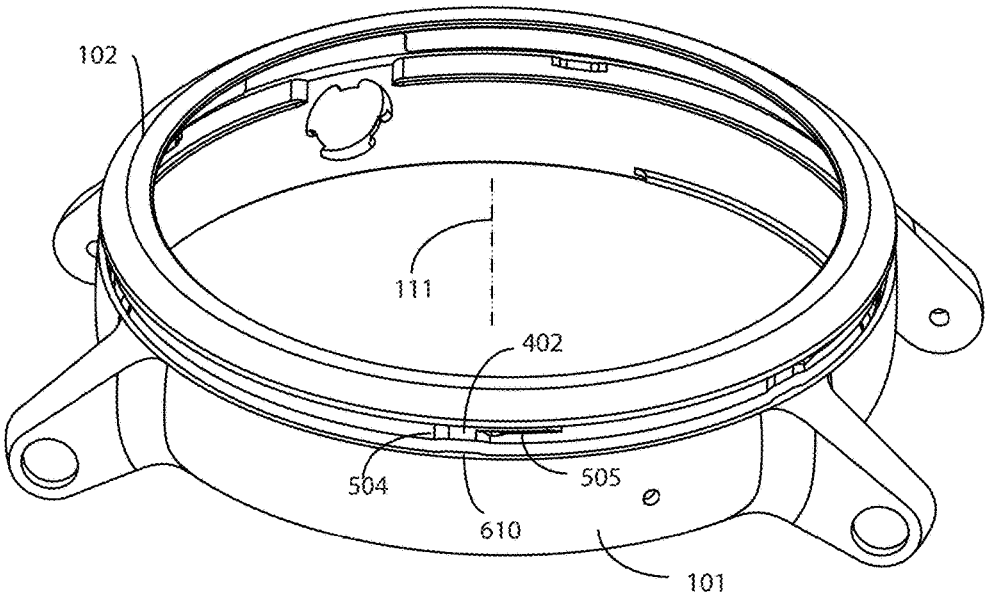
FIG. 11 illustrates an exploded view of one explanatory bezel and one explanatory device case in accordance with one or more embodiments of the disclosure.

Turning now to FIGS. 10-11, illustrated therein are the insert 903 and the bezel 102 oriented in the first rotational alignment (112) relative to the case 101, respectively. The device body 103 is omitted from FIG. 11 so that one or more of the engagement members 611 can be more readily seen. As best shown in FIG. 11, when in the first rotational alignment (112), the insert 903 or bezel 102 can move along the central axis 111 toward the case 101 such that the short side 504 of each complementary engagement feature 402 aligns with a corresponding engagement member 610. The engagement member 610 passes along the short side 504 of the complementary engagement feature 402 as the insert 903 or bezel 102 moves toward the case 101 along the central axis 901. Motion in this direction ceases when the engagement member 610 has traveled the length of the short side 504 of the complementary engagement feature 402. This point is shown at FIG. 12.

Figure 12:
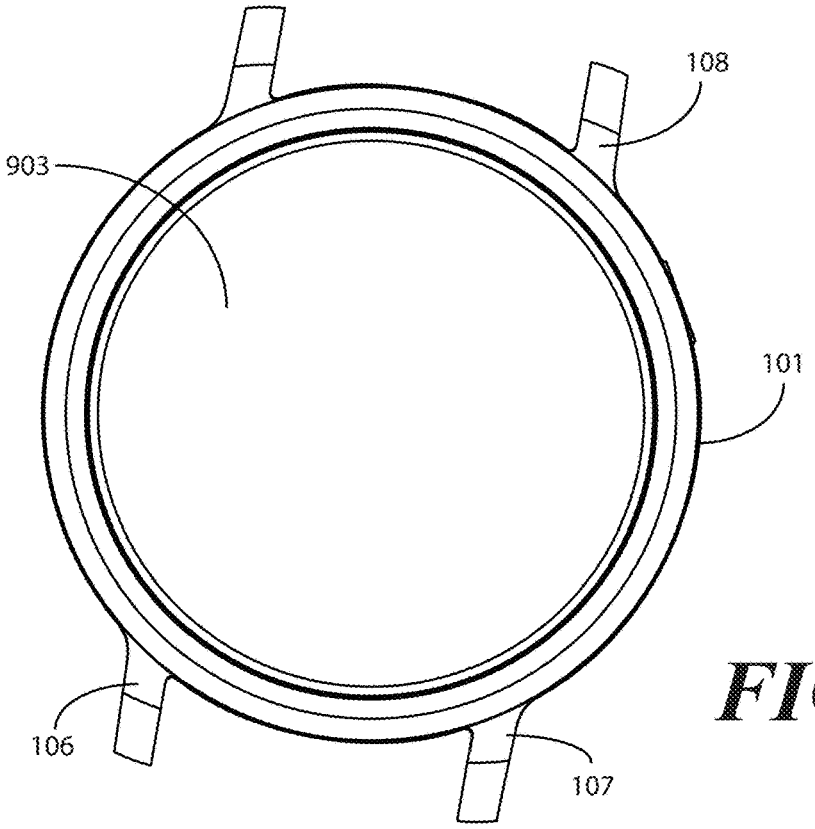
FIG. 12 illustrates a plan view of one explanatory bezel and one explanatory device case in accordance with one or more embodiments of the disclosure, with the device case disposed in a first rotational alignment body relative to the bezel.
Figure 13:
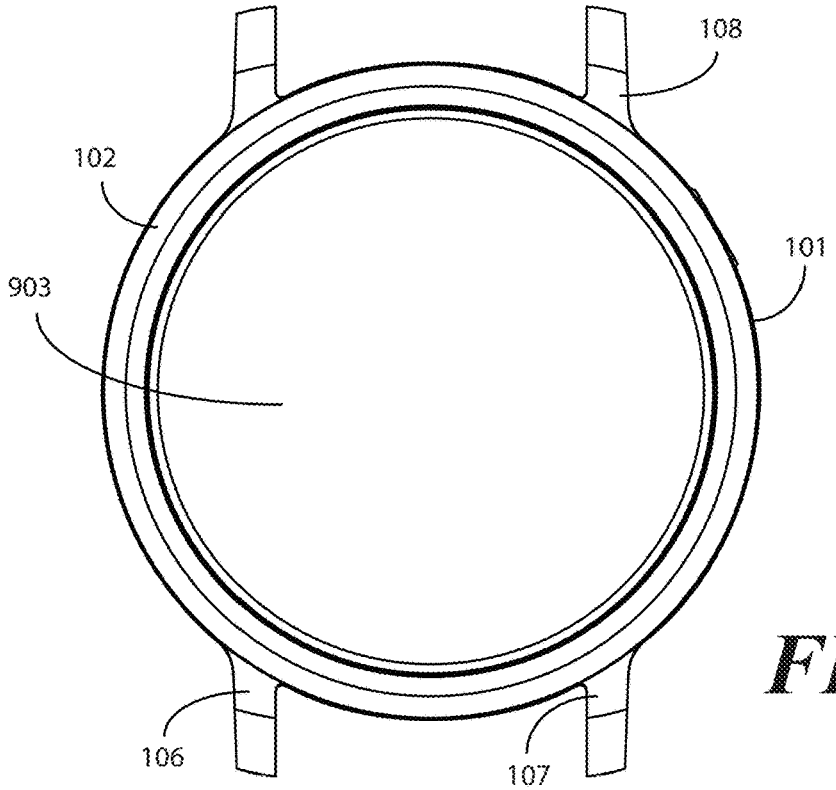
FIG. 13 illustrates a plan view of one explanatory bezel and one explanatory device case in accordance with one or more embodiments of the disclosure, with the device case rotated to a second rotational alignment body relative to the bezel.

Turning now to FIG. 12, the insert 903 is seated within the case 101 at the first rotational alignment (112), which is indicated by the lugs 106,107,108 of the case 101 being oriented diagonally upward and to the right along the page. At this point, the one or more protrusions defining the one or more engagement members (209,210,211,212,213) are to travel along a long side (505) of the complementary engagement features (402,403,501,502,503) when the insert 903 is rotated (113) from the first rotational alignment (112) to the second rotational alignment (114). The result of this rotation is shown in FIG. 13, where the lugs 106,107,108 of the case 101 are oriented vertically. The bezel 102 of the insert 903 now retains the device body (103) securely within the case 101.

Figure 14:
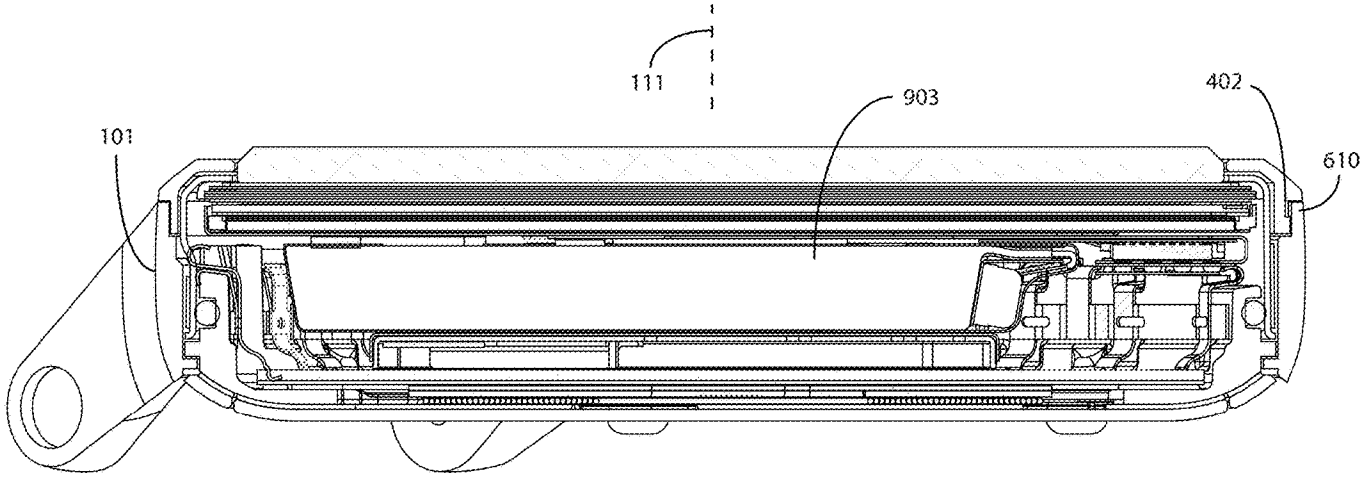
FIG. 14 illustrates a sectional view of one explanatory bezel and one explanatory device case in accordance with one or more embodiments of the disclosure, with the device case disposed in a first rotational alignment body relative to the bezel.
Figure 15:
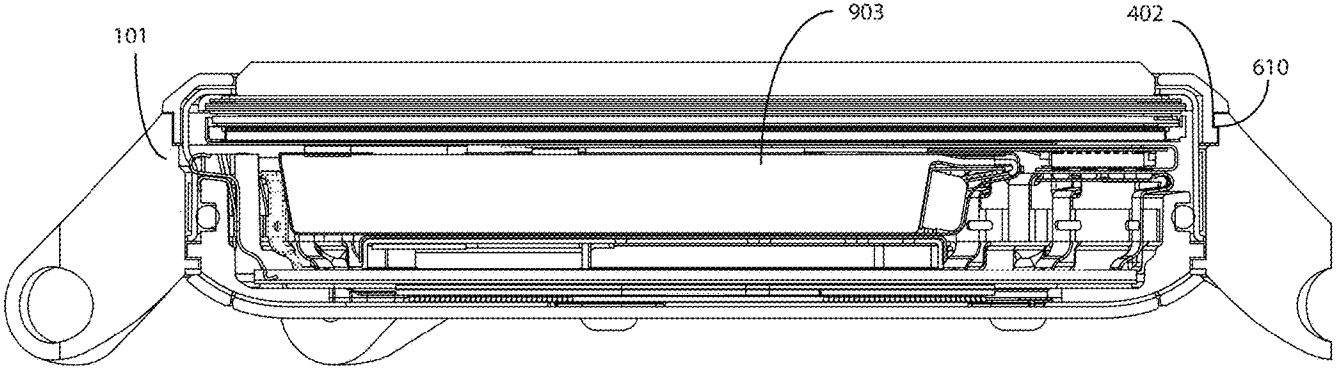
FIG. 15 illustrates a sectional view of one explanatory bezel and one explanatory device body, case, and bezel in accordance with one or more embodiments of the disclosure, with the device body and bezel rotated to a second rotational alignment body relative to the case.

This process is shown sectionally in FIGS. 14-15. Beginning with FIG. 14, the insert 903 is seated within the case 101 at the first rotational alignment (112). When in the first rotational alignment (112), each complementary engagement feature 402 aligns with a short side (504) of corresponding engagement member 610. The engagement member 610 passes along the short side (504) of the complementary engagement feature 402 as the insert 903 moves toward the case 101 along the central axis 111. At FIG. 15, the insert 903 has been rotated to the second rotational alignment (114), thereby locking the engagement member 610 into the long side (505) of the complementary engagement feature 402.

Figure 16:
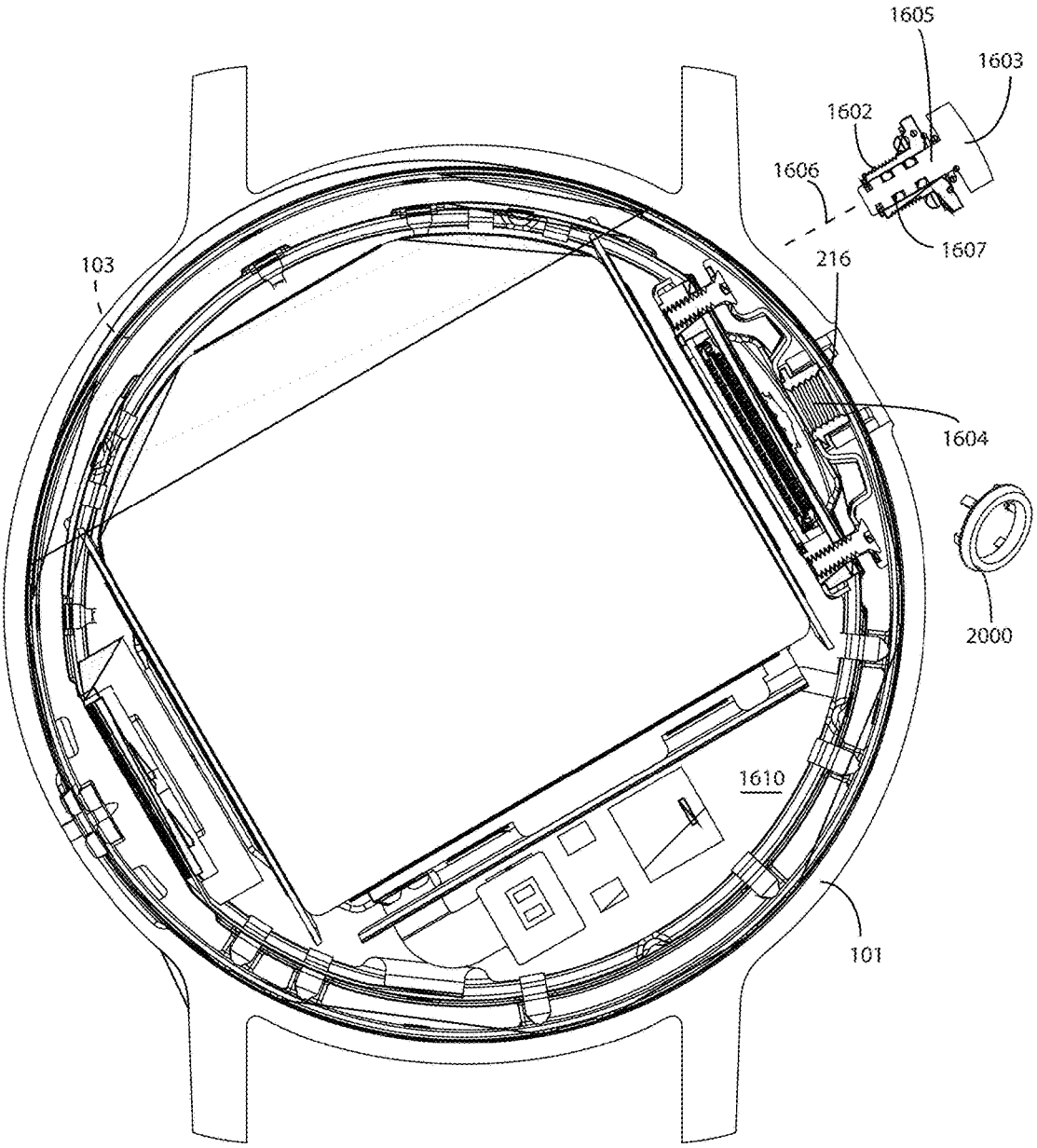
FIG. 16 illustrates another sectional view of one explanatory bezel and one explanatory device body, case, and bezel in accordance with one or more embodiments of the disclosure, with the device body and bezel rotated to a second rotational alignment body relative to the case.
Figure 17:
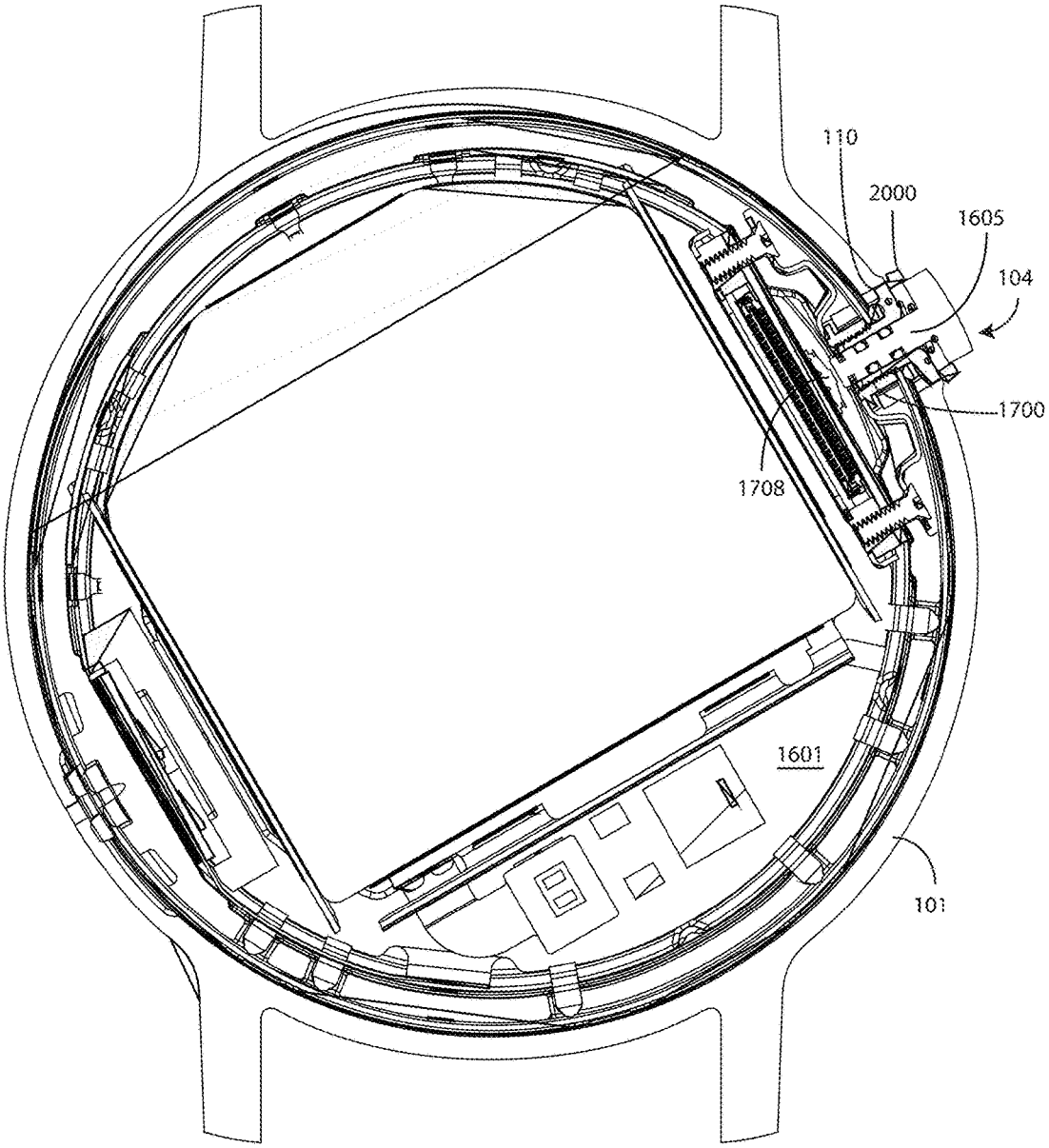
FIG. 17 illustrates the view of FIG. 16 with a crown stem engaging a device body through an aperture in a case in accordance with one or more embodiments of the disclosure.

Turning now to FIGS. 16 and 17, illustrated therein is how the crown stem 104 can be used as an axial retention device to retain the device body 103 in the second rotational alignment (114) about the central axis (111) relative to the case 101. Before illustrating this, it should be noted that the crown stem 104 can take various forms. It can be a simple mechanical coupler including a threaded stem and a broader crown. However, in other embodiments, it can become a complex actuation tool as described above with reference to FIGS. 19-28. This actuation tool can not only operate as an axial retention device, but can also act an a control mechanism or user input for an electronic device.

In FIGS. 16 and 17, the device body 103 houses an electronic device 1610. In this embodiment, the electronic device 1610 is a smart watch. However, the electronic device 1610 can be any type of electronic device, including a radio, multimedia viewer, gaming device, wellness device, heart rate monitor, medical device, wireless communication device, or combinations thereof. Other electronic devices will be obvious to those of ordinary skill in the art having the benefit of this disclosure.

In one embodiment, the crown stem 104 comprises a threaded male member 1602 extending distally from a crown 1603. In one embodiment, the receiving aperture 216 of the device body 103 comprises a female threaded member 1604. In one embodiment, the crown stem 104 further comprises a push button 1605 disposed along a crown stem central axis 1606 of the crown stem 104. In one embodiment, the push button 1605 is biased by a spring 1607 away from the device body 103 in a default state. An optional collar 2000 can snap about the crown stem 104 to prevent rotation of the crown stem 104 relative to the receiving aperture 216 as previously described.

When the threaded male member 1602 of the crown stem 104 is screwed into the female threaded member 1604 of the device body 103, an optionally the collar 2000 is snapped in place, as shown in FIG. 17, the push button 1605 can be used as a user input or electronic device control device. For instance, in one embodiment the push button 1605 is operable to actuate one or more functions of the electronic device 1610. Illustrating by example, in one embodiment where the electronic device 1610 is a wireless communication device, the push button 1605 can be pressed to actuate a switch 1708 of the electronic device 1610 to actuate one or more functions. Pressing the push button 1605 a first time, or for a first duration, may transition the wireless communication device between an active or operational mode and a low-power or sleep mode. Pressing the push button 1605 a second time, or for a second duration, may transition the wireless communication device back to a low-power or sleep mode. These functions are illustrative only, as others will be readily apparent to those of ordinary skill in the art having the benefit of this disclosure.

Additionally, when threaded male member (1602) of the crown stem 104 is screwed into the female threaded member (1604) of the device body (103), a hermetic seal 1700 is formed between the device body (103) and the crown stem 104. Placement of the collar 2000 about the crown stem 104 advantageously prevent this hermetic seal 1700 from being compromised by preventing rotation of the crown stem 104 relative to the case 101 or device body 103. Accordingly, the crown stem 104 can hermetically seal the receiving aperture (216) when coupled to the device body (103) through the aperture 110 of the case 101 to provide a waterproof device.

Figure 18:
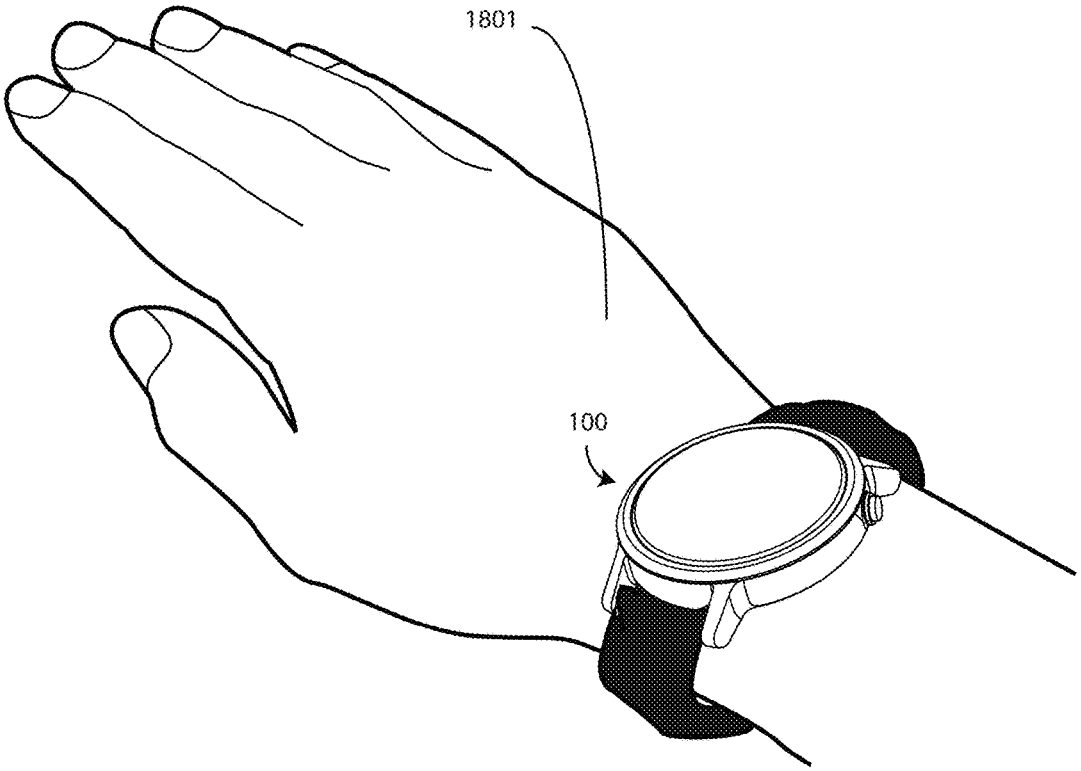
FIG. 18 illustrates one explanatory device in accordance with one or more embodiments of the disclosure being worn by a user.

Turning now to FIG. 18, a user 1801 is shown wearing a device 100 in accordance with one or more embodiments of the disclosure. In one or more embodiments the device 100 is waterproof. As shown in FIG. 18, the device 100 defines a wristwatch appearance that is cleverly worn on the user's wrist. As noted above, other appearances of the device 100 will be obvious to those of ordinary skill in the art having the benefit of this disclosure.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A device, comprising:

a case comprising a case sidewall defining a circular receiver having a receiving opening and a central axis, the case sidewall defining at least one aperture having an aperture axis oriented substantially orthogonally with the central axis;

a waterproof device body comprising a sidewall defining a receiving aperture, the waterproof device body to insert into the circular receiver along the central axis;

a crown stem comprising a push button disposed within a duct of a threaded bushing and one or more O-rings disposed about the push button to allow translation of the push button in the duct while preventing liquids from passing through the duct, the push button defining at least one recess; and a retention clip attached to a shaft of the push button to retain the push button within the duct;

the crown stem to insert through the at least one aperture and the threaded bushing to hermetically seal the receiving aperture when the waterproof device body is inserted into the circular receiver to prevent the liquids from entering the receiving aperture.

2. The device of claim 1, further comprising a spring disposed between the threaded bushing and the push button to apply a pre-loading force biasing the push button away from the waterproof device body.

3. The device of claim 2, wherein the retention clip attaches to the shaft when the push button is passed through the duct from a first side of the threaded bushing far enough that the at least one recess extends through a second side of the threaded bushing.

4. The device of claim 1, the spring disposed at a first end of the threaded bushing, the retention clip disposed at a second end of the threaded bushing.

5. The device of claim 1, the one or more O-rings comprising two 0-rings.

6. The device of claim 1, the push button comprising a crown boss and a shaft extending distally from the crown boss, the shaft defining one or more recesses.

7. The device of claim 6, the one or more O-rings disposed in the one or more recesses on a one-to-one basis.

8. The device of claim 1, the threaded bushing comprising a base member and a threaded male member, the base member defining one or more slots disposed about a perimeter of the base member.

9. The device of claim 8, further comprising another O-ring disposed about the threaded bushing adjacent to the base member.

10. The device of claim 8, further comprising a collar, the collar comprising one or more cantilevered snap elements to engage the one or more slots to retain the threaded bushing in the receiving aperture.

11. The device of claim 10, the case further comprising one or more mechanical stops to limit insertion of the crown stem into the at least one aperture.

12. The device of claim 11, the one or more cantilevered snap elements to extend beyond the one or more mechanical stops when the crown stem hermetically seals the receiving aperture and the one or more cantilevered snap elements engage the one or more slots.

13. The device of claim 1, the waterproof device body comprising an electronic device, the push button operable to actuate one or more functions of the electronic device.

14. The device of claim 13, the electronic device comprising a wireless communication device, the push button operable to transition the wireless communication device between an active mode and a low power or sleep mode.

15. The device of claim 1, further comprising a bezel coupled to the waterproof device body.

16. A device, comprising:

a case defining a circular receiver having a central axis and comprising an aperture oriented substantially orthogonally with the central axis;

an insert to seat within the circular receiver, the insert comprising a receiving opening;

a crown stem comprising a push button disposed within a duct of a threaded bushing and one or more O-rings disposed about the push button to allow translation of the push button in the duct while preventing liquids from passing through the duct; and a collar coupled to the crown stem to prevent rotation of the crown stem relative to the receiving opening;

the crown stem to hermetically seal the receiving opening when coupled to the insert through the aperture.

17. The device of claim 16, the insert comprising a bezel coupled to an electronic device.

18. The device of claim 17, the insert waterproof when the crown stem hermetically seals the receiving opening.

* * * * *